US008094108B2

(12) United States Patent
Higashino et al.

(10) Patent No.: US 8,094,108 B2
(45) Date of Patent: Jan. 10, 2012

(54) LIQUID CRYSTAL DISPLAY DEVICE AND LIQUID CRYSTAL DISPLAY DRIVING CIRCUIT

(75) Inventors: Hiroyuki Higashino, Mie (JP); Tetsuya Umehara, Mie (JP); Yasuki Mori, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 1221 days.

(21) Appl. No.: 11/792,039

(22) PCT Filed: Jan. 30, 2006

(86) PCT No.: PCT/JP2006/001487

§ 371 (c)(1),
(2), (4) Date: Jun. 1, 2007

(87) PCT Pub. No.: WO2006/082791

PCT Pub. Date: Aug. 10, 2006

(65) Prior Publication Data

US 2008/0012840 A1 Jan. 17, 2008

(30) Foreign Application Priority Data

Feb. 1, 2005 (JP) ..... 2005-025245

(51) Int. Cl.
*G09G 3/36* (2006.01)

(52) U.S. Cl. ..... 345/89; 345/96

(58) Field of Classification Search ..... 345/22, 345/63, 87, 89, 90, 94, 95, 96, 97, 98, 204, 345/208–211, 213
See application file for complete search history.

(56) References Cited

U.S. PATENT DOCUMENTS

| | | | |
|---|---|---|---|
| 5,583,532 | A | 12/1996 | Watanabe |
| 5,640,174 | A | 6/1997 | Kamei et al. |
| 6,621,478 | B1 | 9/2003 | Sakaguchi et al. |
| 6,831,620 | B1 | 12/2004 | Nishikubo et al. |

(Continued)

FOREIGN PATENT DOCUMENTS

| | | |
|---|---|---|
| JP | 5-203918 | 8/1993 |
| JP | 7-92937 | 4/1995 |
| JP | 7-333576 | 12/1995 |

(Continued)

OTHER PUBLICATIONS

International Search Report (PCT/ISA/210).

*Primary Examiner* — Amare Mengistu
*Assistant Examiner* — Dmitriy Bolotin
(74) *Attorney, Agent, or Firm* — Harness, Dickey & Pierce, P.L.C.

(57) ABSTRACT

A gradation voltage adjustment section for increasing a positive gradation voltage VHX of an X-th gradation and a negative gradation voltage of the X-th gradation so that the increment corresponds to a charge pull-in amount ΔV is provided in a gradation voltage generation circuit of each source driver. In at least one embodiment, a center value between the positive and negative gradation voltages is adjusted for each driver in accordance with a slant of the charge pull-in amount ΔV in a direction of a gate signal line, thereby suppressing a flicker without varying a gradation characteristic. Further, a center value between the positive and negative gradation voltages is adjusted for each horizontal line or for every plural lines in a single frame in accordance with a horizontal direction deviation and a vertical direction deviation of the charge pull-in amount ΔV in a transfer block, thereby suppressing a flicker without varying a gradation characteristic.

57 Claims, 10 Drawing Sheets

U.S. PATENT DOCUMENTS

| | | | | |
|---|---|---|---|---|
| 7,023,458 | B2 * | 4/2006 | Kudo et al. | 345/690 |
| 2003/0201959 | A1 * | 10/2003 | Sakaguchi | 345/87 |
| 2004/0070579 | A1 * | 4/2004 | Kurihara | 345/204 |
| 2005/0200584 | A1 * | 9/2005 | Kudo et al. | 345/89 |
| 2006/0033695 | A1 * | 2/2006 | Kudo et al. | 345/89 |
| 2006/0087483 | A1 * | 4/2006 | Takada et al. | 345/89 |

FOREIGN PATENT DOCUMENTS

| | | | | |
|---|---|---|---|---|
| JP | 11-133919 | | 5/1999 | |
| JP | 2001-022325 | | 1/2001 | |
| JP | 2001-100711 | | 4/2001 | |
| JP | 2001-242833 | | 9/2001 | |
| WO | WO 2004003641 | A1 * | 1/2004 | 345/89 |

* cited by examiner

LIQUID CRYSTAL DISPLAY DEVICE AND LIQUID CRYSTAL DISPLAY DRIVING CIRCUIT

TECHNICAL FIELD

The present invention relates to (i) a liquid crystal display device such as an active matrix type liquid crystal display device used in a display screen such as a television device display, a personal computer monitor, and the like, and (ii) a liquid crystal display driving circuit used in the liquid crystal display device.

BACKGROUND ART

Conventionally, a liquid crystal display device includes a plurality of scanning signal lines (gate signal lines) and a plurality of video signal lines (source signal lines) which intersect with each other, and includes a liquid crystal panel having display pixel sections, disposed in a matrix manner, each of which is provided in each of areas sectioned by both the signal lines so as to be connected to each gate signal line and each source signal line. Each display pixel section includes: a liquid crystal capacitor Clc provided between a pixel electrode and a counter electrode; and a thin film transistor (TFT) whose gate electrode is connected to the gate signal line, source electrode is connected to the source signal line, and drain electrode is connected to the pixel electrode, wherein an auxiliary capacitor Cs is provided as necessary.

In a vicinity of the liquid crystal panel, source drivers are provided so as to correspond to the plurality of source signal lines respectively, and each of the source drivers supplies to corresponding source lines, a video signal corresponding to video display of each display pixel sections connected to the source signals. In order to prevent burning of liquid crystal, the video signal is such that positive polarity and negative polarity with respect to a counter electrode potential are alternately supplied. Such driving of the liquid crystal panel is referred to as "inversion driving".

Further, in the vicinity of the liquid crystal panel, gate drivers are provided so as to correspond to the plurality of gate signal lines, wherein each of the gate drivers supplies to corresponding gate signal lines scanning signal for selectively driving a display pixel section connected to the gate signal line.

In each pixel section, when the scanning signal causes the TFT to be ON, the video signal is supplied to the pixel electrode via the TFT, and orientation of liquid crystal serving as a display medium sandwiched by both the electrodes varies according to a potential difference between a counter electrode potential and a pixel electrode potential, so that not only letters, symbols, and the like, but also various kinds of images are displayed in the display screen with entire pixel sections.

In the liquid crystal display device, each display pixel includes not only the liquid crystal capacitor Clc and the auxiliary capacitor Cs but also a source-drain parasitic capacitance Cgd of the TFT. Thus, in each pixel section, a charge pull-in voltage (charge pull-in amount) ΔV expressed by the following expression 1 occurs due to the gate-drain parasitic capacitance Cgd, so that a voltage actually applied to the liquid crystal varies so that the variation corresponds to the charge pull-in amount ΔV. Note that, in the following expression 1, VGH represents a gate high voltage of the scanning signal line, and VGL represents a gate low voltage of the scanning signal line.

$$\Delta V=\{Cgd/(Cgd+Clc+Cls)\}\times(VGH-VGL)$$

Further, the charge pull-in amount ΔV varies in the display screen of the liquid crystal panel, so that there occurs a flicker, that is, a displayed image flickers. Examples of the flicker include the following two types.

(1) In the liquid crystal panel, there are a wiring resistance and a parasitic capacitance in the gate signal line, so that a gate signal has a round waveform as further away from a signal input terminal side of the gate signal line. As a result, the charge pull-in amount ΔV varies due to the gate-drain parasitic capacitance Cgd of each pixel section. The variation of the charge pull-in amount ΔV causes occurrence of a deviation of a center value between a voltage applied to a liquid crystal layer at the time of positive driving in the display screen of the liquid crystal panel and a voltage applied to the liquid crystal layer at the time of negative driving, so that the flicker occurs.

(2) In the step of forming a pixel pattern on a glass substrate, it is difficult to form the pixel pattern on an entire surface of the glass substrate at once in case where the glass substrate has a large surface area, so that the surface area is divided into plural blocks and then formation of the pixel pattern is carried out plural times so as to correspond to the blocks. In this case, the gate-drain parasitic capacitance Cgd has a deviation in the display screen of the liquid crystal panel due to an alignment position or a pattern formation device's characteristic and the like. The deviation of the parasitic capacitance Cgd results in variation of the charge pull-in amount ΔV expressed by the aforementioned expression. Thus, there occurs a deviation of a center value between a voltage applied to a liquid crystal layer at the time of positive driving in the display screen of the liquid crystal panel and a voltage applied to the liquid crystal layer at the time of negative driving, so that the flicker occurs.

The flicker (1) is caused by the round waveform of the gate signal. Generally, the gate signal lines are disposed in a horizontal direction in the display screen, so that it is possible to reduce the flicker by correcting a slant of the charge pull-in amount ΔV in the horizontal direction.

Further, the flicker (2) is caused by a characteristic in the step of forming the pixel pattern. Thus, in case where formation of the pixel pattern is carried out plural times, it is possible to reduce the flicker by correcting the deviation of the charge pull-in amount ΔV in each formation block.

Further, Japanese Unexamined Patent Publication No. 22325/2001 (Tokukai 2001-22325) (Publication date: Jan. 26, 2001) (hereinafter, referred to as "Patent Document 1") discloses a liquid crystal display device arranged so that an element which can obtain a desired resistance by an external input such as a potentiometer is provided on a gradation voltage generation circuit so as to be capable of adjusting a gradation characteristic without varying a circuit constant after designing a driving circuit.

DISCLOSURE OF INVENTION

The factors of the aforementioned two types of flickers are basically different from each other, but both the flickers are caused by the deviation of the charge pull-in amount ΔV in the display screen of the liquid crystal panel. Thus, it is possible to reduce the flicker by adjusting a value of a gradation voltage applied to the liquid crystal layer in accordance with the deviation of the charge pull-in amount ΔV in the display screen of the liquid crystal panel.

However, variation caused by the adjustment of the gradation voltage value results in not only variation such as a flicker caused by a deviation of a center value between a positive voltage and a negative voltage in each gradation but also variation of a display quality due to gradation characteristic variation such as so-called Γ value variation. Thus, a structure which allows reduction of the flicker without varying the gradation characteristic is required.

According to the technique of Patent Document 1, it is possible to easily adjust the gradation voltage after designing the driving circuit, but the adjustment of the gradation voltage results in variation of the display quality due to variation of the gradation characteristic.

The present invention is to solve the foregoing conventional problems, and an object of the present invention is to provide (i) a liquid crystal display device which can reduce the flicker without varying the gradation characteristic and (ii) a liquid crystal display driving circuit used in the liquid crystal display device.

A liquid crystal display device of the present invention comprising: a gradation voltage generation circuit for generating a gradation voltage for display; a plurality of scanning signal lines and a plurality of video signal lines which intersect with each other; and a plurality of pixel sections, provided in a two dimensional manner, which are sectioned by the scanning signal lines and the video signal lines, the gradation voltage which corresponds to each video data signal being supplied to each of the pixel sections so as to make a display, wherein the gradation voltage generation circuit includes a gradation voltage adjustment section for carrying out voltage adjustment by increasing a positive gradation voltage VH(X) of an X-th gradation and a negative gradation voltage VL(X) of the X-th gradation so that the increment corresponds to an adjustment voltage of a pixel section connected to a corresponding video signal line, thereby achieving the foregoing object.

Further, it is preferable to arrange the liquid crystal display device so as to comprise a control section for outputting the gradation voltage and various kinds of control signals to a source driver for supplying the gradation voltage to the video signal lines, wherein the gradation voltage generation circuit is provided in the control section Further, it is preferable to arrange the liquid crystal display device so as to comprise a source driver for supplying the gradation voltage to the video signal lines, wherein the gradation voltage generation circuit is provided in the source driver.

Preferably, a liquid crystal display device of the present invention comprising: a display section which includes a plurality of scanning signal lines and a plurality of video signal lines so that the scanning signal lines and the video signal lines intersect with each other and which includes pixel sections sectioned by the scanning signal lines and the video signal lines so that the pixel sections are provided in a matrix manner; a plurality of source drivers, provided in a vicinity of the display section so as to respectively correspond to a predetermined number of the video signal lines, each of which source drivers selectively supplies a positive gradation voltage or a negative gradation voltage as a video signal; and a plurality of gate drivers, provided in a vicinity of the display section so as to respectively correspond to a predetermined number of the scanning signal lines, each of which gate drivers selectively supplies a scanning signal for driving each of the pixel sections to each of the scanning signal lines; wherein gradation voltage generation circuits each of which generates a gradation voltage for display are provided in the source drivers respectively, and each of the gradation voltage generation circuits includes a gradation voltage adjustment section for carrying out voltage adjustment by increasing a positive gradation voltage VH(X) of an X-th gradation and a negative gradation voltage VL(X) of the X-th gradation so that the increment corresponds to an adjustment voltage of a pixel section connected to a corresponding video signal line, thereby achieving the foregoing object.

Further, it is preferable to arrange the liquid crystal display device so that the pixel section includes (i) a switch element whose control terminal is connected to a scanning signal line in a vicinity of each of the junctions of the scanning signal lines and the video signal lines and whose one driving region is connected to a video signal line in the vicinity of the junction and (ii) a pixel electrode connected to the other driving region of the switch element.

Further, it is preferable to arrange the liquid crystal display device so that the gradation voltage adjustment section carries out voltage adjustment for each video signal line or every plural video signal line in a single frame by increasing the positive gradation voltage VH(X) of the X-th gradation and the negative gradation voltage VL(X) of the X-th gradation so that the increment corresponds to the adjustment voltage of the pixel section connected to the corresponding video signal line.

Further, it is preferable to arrange the liquid crystal display device so that the gradation voltage adjustment section carries out voltage adjustment for each video signal line or every plural video signal line in a single frame by increasing the positive gradation voltage VH(X) of the X-th gradation and the negative gradation voltage VL(X) of the X-th gradation so that the increment corresponds to the adjustment voltage of the pixel section connected to the corresponding scanning signal line.

Further, it is preferable to arrange the liquid crystal display device so that the gradation voltage adjustment section carries out voltage adjustment for each source driver by increasing the positive gradation voltage VH(X) of the X-th gradation and the negative gradation voltage VL(X) of the X-th gradation so that the increment corresponds to the adjustment voltage of the pixel section connected to the corresponding video signal line.

Further, it is preferable to arrange the liquid crystal display device so that the gradation voltage adjustment section carries out voltage adjustment for each source driver by increasing the positive gradation voltage VH(X) of the X-th gradation and the negative gradation voltage VL(X) of the X-th gradation so that the increment corresponds to the adjustment voltage of the pixel section connected to the corresponding scanning signal line.

Further, it is preferable to arrange the liquid crystal display device so that the adjustment voltage is set so as to correspond to a slant of a charge pull-in amount ΔV in a direction of the scanning signal line.

Further, it is preferable to arrange the liquid crystal display device so that the adjustment voltage is set so as to correspond to a slant of a charge pull-in amount ΔV in a direction of the video signal line.

Further, it is preferable to arrange the liquid crystal display device so that the adjustment voltage is set so as to correspond to a horizontal direction and/or vertical direction deviation of the charge pull-in amount ΔV in a transfer block when a panel in-plane deviation which occurs in the charge pull-in amount ΔV due to a plural-region divisional transfer is a horizontal direction and/or vertical direction deviation.

Further, it is preferable to arrange the liquid crystal display device so that at each timing when each scanning signal line or every plural scanning signal lines are selectively driven or at each timing when the gate driver is driven, the gradation voltage adjustment section varies the voltage VH(X) and VL(X) including the adjustment voltage or voltages corresponding to the voltage VH(X) and VL(X) including the adjustment voltage in a time base manner so that the voltage is optimal for the charge pull-in amount ΔV of the pixel section connected to the corresponding scanning signal line.

Further, it is preferable to arrange the liquid crystal display device so that the gradation voltage adjustment section shifts a minimum value and a maximum value of a gradation voltage range, between which the positive gradation voltage VH(X) of the X-th gradation exists, so that also the gradation voltage range between the minimum value and the maximum value is shifted, so as to cause each of the minimum value and the maximum value to be higher by the adjustment voltage, and the gradation voltage adjustment section shifts a minimum value and a maximum value of a gradation voltage range, between which the negative gradation voltage VL(X) of the X-th gradation exists, as well as the gradation voltage range, so as to cause each of the minimum value and the maximum value to be higher by the adjustment voltage.

Further, it is preferable to arrange the liquid crystal display device so that the gradation voltage generation circuit includes: a first voltage dividing circuit for generating a plurality of positive and negative reference voltages from positive and negative standard voltages; a second voltage dividing circuit for generating a positive gradation voltage from a positive reference voltage; and a third voltage dividing circuit for generating a negative gradation voltage from a negative reference voltage, and the gradation voltage adjustment section outputs (i) a voltage obtained by increasing each reference voltage of the first voltage dividing circuit so that the increment corresponds to an output adjustment voltage or (ii) a voltage corresponding to that obtained voltage, to each of the second and third voltage dividing circuits.

Further, it is preferable to arrange the liquid crystal display device so that the gradation voltage adjustment section outputs (I) voltages respectively obtained by increasing high and low positive reference voltages of the first voltage dividing circuit so that the increment corresponds to the output adjustment voltage or (II) voltages corresponding to those obtained voltages, respectively as a maximum value and a minimum value of a gradation voltage range of the second voltage dividing circuit, and the gradation voltage adjustment section outputs (III) voltages respectively obtained by increasing high and low negative reference voltages of the first voltage dividing circuit so that the increment corresponds to the output adjustment voltage or (IV) voltages corresponding to those obtained voltages, respectively as a maximum value and a minimum value of a gradation voltage range of the third voltage dividing circuit.

Further, it is preferable to arrange the liquid crystal display device so that the gradation voltage adjustment section includes: one or more adjustment voltage generation circuits each of which generates an adjustment voltage so as to correspond to a gradation voltage adjustment signal supplied from a control section; and differential amplification circuits each of which differentially amplifies a voltage obtained by adding the output adjustment voltage of the adjustment voltage generation circuit to a predetermined reference voltage.

Further, it is preferable to arrange the liquid crystal display device so that the adjustment voltage generation circuit includes: a variable resistance element whose resistance value is variable in accordance with a voltage value of the gradation voltage adjustment signal; and buffer means for receiving an output voltage from the variable resistance element.

Further, it is preferable to arrange the liquid crystal display device so that the variable resistance element is a potentiometer.

Further, it is preferable to arrange the liquid crystal display device so that the differential amplification circuits are provided so as to respectively correspond to a positive maximum gradation voltage, a positive minimum gradation voltage, a negative maximum gradation voltage, and a negative minimum gradation voltage, and a positive input terminal of each of the differential amplification circuits is connected to an output terminal via which a predetermined reference voltage is outputted from the first voltage dividing circuit and an output terminal of the adjustment voltage generation circuit, and an output terminal of each of the differential amplification circuits are connected to either the second voltage dividing circuit or the third voltage dividing circuit.

Further, it is preferable to arrange the liquid crystal display device so that: the differential amplification circuits are first to fourth differential amplification circuits, and the first differential amplification circuit receives via its positive input terminal a voltage obtained by increasing a positive first reference voltage of the first voltage dividing circuit so that the increment corresponds to the output adjustment voltage and the first differential amplification circuit outputs an output voltage to a part of an output terminal via which the maximum value of the gradation voltage range of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which the minimum value of the gradation voltage range of the second voltage dividing circuit is outputted, and the third differential amplification circuit receives via its positive input terminal a voltage obtained by increasing a negative third reference voltage of the first voltage dividing circuit so that the increment corresponds to the output adjustment voltage and the third differential amplification circuit outputs an output voltage to a part of an output terminal via which a maximum value of a gradation voltage range of the third voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a minimum value of the gradation voltage range of the third voltage dividing circuit is outputted.

Further, it is preferable to arrange the liquid crystal display device so that: the adjustment voltage generation circuits are first to n-th (n is a natural number not less than 2) adjustment voltage generation circuits for generating, adjustment voltages corresponding to respective gradations, and the number of the differential amplification circuits is n×2 so as to correspond to each of positive and negative gradation voltages, and a positive input terminal of each of the differential amplification circuits is connected to (I) an output section via which a predetermined reference voltage is outputted from the first voltage dividing circuit and (II) any one of output terminals of the first to n-th adjustment voltage generation circuits which corresponds to the output section, and an output terminal of each of the differential amplification circuits is connected to either a position of the second voltage dividing circuit or a position of the third voltage dividing circuit so that the positions correspond to each other as positive and negative sides.

Further, it is preferable to arrange the liquid crystal display device so that: the adjustment voltage generation circuits are first to third adjustment voltage generation circuits for generating adjustment voltages according to gradations respectively corresponding to a maximum gradation voltage, an intermediate gradation voltage, and a minimum gradation voltage, and the differential amplification circuits are provided so that output voltage values thereof respectively become a positive maximum gradation voltage, a positive intermediate gradation voltage, a positive minimum gradation voltage, a negative maximum gradation voltage, a negative intermediate gradation voltage, a negative minimum gradation voltage, and a positive input terminal of each of the differential amplification circuits is connected to (I) an output section via which a predetermined reference voltage is outputted from the first voltage dividing circuit and (II) any one of output terminals of the first to third adjustment voltage generation circuits which corresponds to the output section, an output terminal of each of the differential amplification circuits is connected to either the second voltage dividing circuit or the third voltage dividing circuit so that the second and third voltage dividing circuits symmetrically correspond to each other as positive and negative sides.

Further, it is preferable to arrange the liquid crystal display device so that: the differential amplification circuits are first to sixth differential amplification circuits, and the first differential amplification circuit receives via its positive input terminal a voltage obtained by increasing a positive first reference voltage of the first voltage dividing circuit so that the increment corresponds to the output adjustment voltage of the first adjustment voltage generation circuit and the first differential amplification circuit outputs an output voltage to a part of an output terminal via which a positive maximum gradation voltage of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which a positive intermediate gradation voltage of the second voltage dividing circuit is outputted, and the third differential amplification circuit receives via its positive input terminal a voltage obtained by increasing a positive third reference voltage of the first voltage dividing circuit so that the increment corresponds to the output adjustment voltage and the third differential amplification circuit outputs an output voltage to a part of an output terminal via which a positive minimum gradation voltage of the second voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a negative maximum gradation voltage of the third voltage dividing circuit is outputted, and the fifth differential amplification circuit receives via its positive input terminal a voltage obtained by increasing a negative fifth reference voltage of the first voltage dividing circuit so that the increment corresponds to the output adjustment voltage and the fifth differential amplification circuit outputs an output voltage to a part of an output terminal via which a negative intermediate gradation voltage of the third voltage dividing circuit is outputted, and the sixth differential amplification circuit receives via its positive input terminal a voltage obtained by increasing a negative sixth reference voltage of the first voltage dividing circuit so that the increment corresponds to the output adjustment voltage and the sixth differential amplification circuit outputs an output voltage to a part of an output terminal via which a negative minimum gradation voltage of the third voltage dividing circuit is outputted.

Further, it is preferable to arrange the liquid crystal display device so that the gradation voltage adjustment section carries out voltage adjustment with respect to the positive gradation voltage VH(X) of the X-th gradation and the negative gradation voltage VL(X) of the X-th gradation so that the voltage adjustment corresponds to each of gradations independently.

Further, it is preferable to arrange the liquid crystal display device so as to comprise a first signal transmission line for supplying the gradation voltage adjustment signal and a second signal transmission line for supplying the video data signal so that the first signal transmission line and the second signal transmission line are positioned between the control section and the source driver.

Further, it is preferable to arrange the liquid crystal display device so as to comprise a signal transmission line for commonly supplying the gradation voltage adjustment signal and the video data signal so that the signal transmission line is positioned between the control section and the source driver.

Further, it is preferable to arrange the liquid crystal display device so that: the gradation voltage adjustment signal is supplied via the signal transmission line during a retrace line period, and the video data signal is supplied via the transmission line during a non retrace line period, the source driver further includes (1) a selector circuit control signal generation circuit for generating a selector circuit control signal in accordance with a latch signal and a start pulse which are supplied from the control section and (2) a selector circuit for selecting either the video data signal or the gradation voltage adjustment signal in accordance with the selector circuit control signal.

Further, it is preferable to arrange the liquid crystal display device so that the selector circuit control signal is generated so that the selector circuit control signal rises when the latch signal drops and the selector circuit control signal drops when the start signal rises.

Further, it is preferable to arrange the liquid crystal display device so that the selector circuit selects the gradation voltage adjustment signal during a period corresponding to one level of a binary of the selector circuit control signal so as to output the gradation voltage adjustment signal to the gradation voltage adjustment section, and the selector circuit selects the video data signal during a period corresponding to the other level of the binary so as to output the video data signal.

Further, it is preferable to arrange the liquid crystal display device so that the adjustment voltage is an adjustment voltage used to reduce an image flicker.

Further, it is preferable to arrange the liquid crystal display device so that the adjustment voltage is an adjustment voltage used to shift a center value between a positive gradation voltage and a negative gradation voltage of a standard gradation voltage so that the shift corresponds to a predetermined voltage.

Further, it is preferable to arrange the liquid crystal display device so that the adjustment voltage has a voltage value which depends on (a) an initial set value of the center value between the positive gradation voltage and the negative gradation voltage of the standard gradation voltage and (b) a charge pull-in amount $\Delta V$.

Further, it is preferable to arrange the liquid crystal display device so that the adjustment voltage is a charge pull-in amount $\Delta V$ or corresponds to the charge pull-in amount $\Delta V$.

Further, it is preferable to arrange the liquid crystal display device so that: the pixel section includes (i) a switch element whose control terminal is connected to a scanning signal line in a vicinity of each of the junctions of the scanning signal lines and the video signal lines and whose one driving region is connected to a video signal line in the vicinity of the junction and (ii) a pixel electrode connected to the other driving region of the switch element, and the charge pull-in amount ΔV is expressed as follows $$\Delta V=\{Cgd/(Cgd+Clc+Cs)\}\times(VGH-VGL)$$

where Clc represents a liquid crystal capacitance of the pixel electrode, Cs represents an auxiliary capacitance connected to the liquid crystal capacitance Clc, Cgd represents a transistor gate-drain parasitic capacitance of the switch element, VGH represents a gate high voltage of the scanning signal line, and VGL represents a gate low voltage of the scanning signal line.

A liquid crystal display driving circuit of the present invention comprising a gradation voltage generation circuit for generating a positive and negative display gradation voltage so as to drive a liquid crystal display section by using the display gradation voltage so that the liquid crystal display section displays an image, wherein the gradation voltage generation circuit includes a gradation voltage adjustment section for carrying out voltage adjustment by increasing a positive gradation voltage VH(X) of an X-th gradation and a negative gradation voltage VL(X) of the X-th gradation so that the increment corresponds to an adjustment voltage of a pixel section to which a corresponding video signal is supplied, thereby achieving the foregoing object.

Further, it is preferable to arrange the liquid crystal display driving circuit so as to comprise: a plurality of source drivers each of which supplies the positive and negative display gradation voltage to the liquid crystal display section as a video signal; and a plurality of gate drivers each of which supplies a liquid crystal display driving scanning signal to the liquid crystal display section, wherein the gradation voltage generation circuit is provided in each of the source drivers.

Further, it is preferable to arrange the liquid crystal display driving circuit so that at each timing where the scanning signal lines are driven or at each timing when each of the gate drivers is driven, the gradation voltage adjustment section varies the voltage VH(X) and VL(X) including the adjustment voltage or voltages corresponding to the voltage VH(X) and VL(X) including the adjustment voltage in a time base manner so that the voltage is optimal for a charge pull-in amount ΔV of the pixel section connected to a corresponding scanning signal line.

Further, it is preferable to arrange the liquid crystal display driving circuit so that the gradation voltage adjustment section shifts a minimum value and a maximum value of a gradation voltage range, between which the positive gradation voltage VH(X) of the X-th gradation exists, so that also the gradation voltage range between the minimum value and the maximum value is shifted, so as to cause each of the minimum value and the maximum value to be higher by the adjustment voltage, and the gradation voltage adjustment section shifts a minimum value and a maximum value of a gradation voltage range, between which the negative gradation voltage VL(X) of the X-th gradation exists, as well as the gradation voltage range, so as to cause each of the minimum value and the maximum value to be higher by the adjustment voltage.

Further, it is preferable to arrange the liquid crystal display driving circuit so that the gradation voltage generation circuit includes: a first voltage dividing circuit for generating a plurality of positive and negative reference voltages from positive and negative standard voltages; a second voltage dividing circuit for generating a positive gradation voltage from a positive reference voltage; and a third voltage dividing circuit for generating a negative gradation voltage from a negative reference voltage, and the gradation voltage adjustment section outputs (i) a voltage obtained by increasing each reference voltage of the first voltage dividing circuit so that the increment corresponds to an output adjustment voltage or (ii) a voltage corresponding to that obtained voltage, to each of the second and third voltage dividing circuits.

Further, it is preferable to arrange the liquid crystal display driving circuit so that the gradation voltage adjustment section outputs (I) voltages respectively obtained by increasing high and low positive reference voltages of the first voltage dividing circuit so that the increment corresponds to the output adjustment voltage or (II) voltages corresponding to those obtained voltages, respectively as a maximum value and a minimum value of a gradation voltage range of the second voltage dividing circuit, and the gradation voltage adjustment section outputs (III) voltages respectively obtained by increasing high and low negative reference voltages of the first voltage dividing circuit so that the increment corresponds to the output adjustment voltage or (IV) voltages corresponding to those obtained voltages, respectively as a maximum value and a minimum value of a gradation voltage range of the third voltage dividing circuit.

Further, it is preferable to arrange the liquid crystal display driving circuit so that the gradation voltage adjustment section includes: one or more adjustment voltage generation circuits each of which generates an adjustment voltage so as to correspond to a gradation voltage adjustment signal supplied from a control section; and differential amplification circuits each of which differentially amplifies a voltage obtained by adding the output adjustment voltage of the adjustment voltage generation circuit to a predetermined reference voltage.

Further, it is preferable to arrange the liquid crystal display driving circuit so that the adjustment voltage generation circuit includes: a variable resistance element whose resistance value is variable in accordance with a voltage value of the gradation voltage adjustment signal; and buffer means for receiving an output voltage from the variable resistance element.

Further, it is preferable to arrange the liquid crystal display driving circuit so that the differential amplification circuits are provided so as to respectively correspond to a positive maximum gradation voltage, a positive minimum gradation voltage, a negative maximum gradation voltage, and a negative minimum gradation voltage, and a positive input terminal of each of the differential amplification circuits is connected to an output terminal via which a predetermined reference voltage is outputted from the first voltage dividing circuit and an output terminal of the adjustment voltage generation circuit, and an output terminal of each of the differential amplification circuits are connected to either the second voltage dividing circuit or the third voltage dividing circuit.

Further, it is preferable to arrange the liquid crystal display driving circuit so that: the differential amplification circuits are first to fourth differential amplification circuits, and the first differential amplification circuit receives via its positive input terminal a voltage obtained by increasing a positive first reference voltage of the first voltage dividing circuit so that the increment corresponds to the output adjustment voltage and the first differential amplification circuit outputs an output voltage to a part of an output terminal via which the maximum value of the gradation voltage range of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which the minimum value of the gradation voltage range of the second voltage dividing circuit is outputted, and the third differential amplification circuit receives via its positive input terminal a voltage obtained by increasing a negative third reference voltage of the first voltage dividing circuit so that the increment corresponds to the output adjustment voltage and the third differential amplification circuit outputs an output voltage to a part of an output terminal via which a maximum value of a gradation voltage range of the third voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a minimum value of the gradation voltage range of the third voltage dividing circuit is outputted.

Further, it is preferable to arrange the liquid crystal display driving circuit so that: the adjustment voltage generation circuits are first to n-th (n is a natural number not less than 2) adjustment voltage generation circuits for generating adjustment voltages corresponding to respective gradations, and the number of the differential amplification circuits is n×2 so as to correspond to each of positive and negative gradation voltages, and a positive input terminal of each of the differential amplification circuits is connected to (I) an output section via which a predetermined reference voltage is outputted from the first voltage dividing circuit and (II) any one of output terminals of the first to n-th adjustment voltage generation circuits which corresponds to the output section, and an output terminal of each of the differential amplification circuits is connected to either a position of the second voltage dividing circuit or a position of the third voltage dividing circuit so that the positions correspond to each other as positive and negative sides.

Further, it is preferable to arrange the liquid crystal display driving circuit so that: the adjustment voltage generation circuits are first to third adjustment voltage generation circuits for generating adjustment voltages according to gradations respectively corresponding to a maximum gradation voltage, an intermediate gradation voltage, and a minimum gradation voltage, and the differential amplification circuits are provided so that output voltage values thereof respectively become a positive maximum gradation voltage, a positive intermediate gradation voltage, a positive minimum gradation voltage, a negative maximum gradation voltage, a negative intermediate gradation voltage, a negative minimum gradation voltage, and a positive input terminal of each of the differential amplification circuits is connected to (I) an output section via which a predetermined reference voltage is outputted from the first voltage dividing circuit and (II) any one of output terminals of the first to third adjustment voltage generation circuits which corresponds to the output section, an output terminal of each of the differential amplification circuits is connected to either the second voltage dividing circuit or the third voltage dividing circuit so that the second and third voltage dividing circuits symmetrically correspond to each other as positive and negative sides.

Further, it is preferable to arrange the liquid crystal display driving circuit so that: the differential amplification circuits are first to sixth differential amplification circuits, and the first differential amplification circuit receives via its positive input terminal a voltage obtained by increasing a positive first reference voltage of the first voltage dividing circuit so that the increment corresponds to the output adjustment voltage of the first adjustment voltage generation circuit and the first differential amplification circuit outputs an output voltage to a part of an output terminal via which a positive maximum gradation voltage of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which a positive intermediate gradation voltage of the second voltage dividing circuit is outputted, and the third differential amplification circuit receives via its positive input terminal a voltage obtained by increasing a positive third reference voltage of the first voltage dividing circuit so that the increment corresponds to the output adjustment voltage and the third differential amplification circuit outputs an output voltage to a part of an output terminal via which a positive minimum gradation voltage of the second voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a negative maximum gradation voltage of the third voltage dividing circuit is outputted, and the fifth differential amplification circuit receives via its positive input terminal a voltage obtained by increasing a negative fifth reference voltage of the first voltage dividing circuit so that the increment corresponds to the output adjustment voltage and the fifth differential amplification circuit outputs an output voltage to a part of an output terminal via which a negative intermediate gradation voltage of the third voltage dividing circuit is outputted, and the sixth differential amplification circuit receives via its positive input terminal a voltage obtained by increasing a negative sixth reference voltage of the first voltage dividing circuit so that the increment corresponds to the output adjustment voltage and the sixth differential amplification circuit outputs an output voltage to a part of an output terminal via which a negative minimum gradation voltage of the third voltage dividing circuit is outputted.

Further, it is preferable to arrange the liquid crystal display driving circuit so that the gradation voltage adjustment section carries out voltage adjustment with respect to the positive gradation voltage VH(X) of the X-th gradation and the negative gradation voltage VL(X) of the X-th gradation so that the voltage adjustment corresponds to each of gradations independently.

According to the foregoing arrangements, it is possible to obtain the following effects of the present invention.

According to the present invention, the flicker is reduced without varying the gradation characteristic.

In the liquid crystal display device, a voltage VLC(X) applied to a liquid crystal layer of each pixel section in displaying an X-th gradation is expressed as follows $$VLC(X)=VH(X)-Vcom \text{ (at the time of positive driving)}$$

$$VLC(X)=Vcom-VL(X) \text{ (at the time of negative driving)}$$

where Vcom represents a counter potential, VH(X) represents a positive gradation voltage of an arbitrary X-th gradation, and VL(X) represents a negative gradation voltage of the arbitrary X-th gradation.

When the voltage VLC(X) applied to the liquid crystal layer of each pixel section varies, an electric field applied to the liquid crystal layer varies, so that an optical transmittance varies. Accordingly, a gradation level which is different from a desired gradation level is displayed in the liquid crystal display device, so that the gradation characteristic varies. Thus, in order to prevent the variation of the gradation characteristic, it is necessary that the voltage VLC(X) applied to the liquid crystal layer of each pixel section is fixed to a desired voltage at each gradation level.

However, as described above, there is a charge pull-in amount ΔV caused by a TFT parasitic capacitance Cgd in a TFT substrate. Thus, the voltage VLC(X) actually applied to the liquid crystal layer is expressed as follows $$VLC(X)=(VH(X)-\Delta V)-Vcom \text{ (at the time of positive driving)}$$

$$VLC(X)=Vcom-(VL(X)-\Delta V) \text{ (At the time of negative driving)}$$

where ΔV represents the charge pull-in amount.

In this manner, the positive gradation voltage VHX of the X-th gradation and the negative gradation voltage VLX of the X-th gradation decrease so that the decrement corresponds to the charge pull-in amount ΔV, so that the positive gradation voltage and the negative gradation voltage become unbalanced. As a result, the flicker occurs.

Thus, in the present invention, the positive gradation voltage VHX of the X-th gradation and the negative gradation voltage VLX of the X-th gradation are increased so that the increment corresponds to the charge pull-in amount ΔV, thereby suppressing occurrence of the flicker. The gradation voltages VHX and VLX are respectively increased so that the increment corresponds to the voltage ΔV (charge pull-in amount ΔV) in order to offset the charge pull-in amount ΔV, thereby suppressing occurrence of the flicker while fixing the voltage VLC(X) actually applied to the liquid crystal layer at a desired voltage value.

Further, as described above, (1) the round waveform of the gate signal in the panel plane and (2) the deviation (ω value) of the gate-drain parasitic capacitance Cgd in the panel plane cause the charge pull-in amount ΔV to have a different value. Thus, in order to suppress the flicker in the entire panel plane, it is necessary to appropriately adjust each of the gradation voltages so as to correspond to the charge pull-in amount ΔV in the panel plane.

Thus, according to the present invention, in the liquid crystal display device, for example, a gradation voltage adjustment section is provided on the gradation voltage generation circuit in the source driver, and the positive gradation voltage VHX of the X-th gradation and the negative gradation voltage VLX of the X-th gradation are actively increased in driving the liquid crystal display device so that the increment corresponds to each charge pull-in amount ΔV, thereby suppressing the flicker in the entire panel plane.

For example, the gradation voltage adjustment section is provided for each source driver, and the control section supplies gradation voltage adjustment signals different from each other to the respective source drivers, so that it is possible to set center values each of which is a value between the positive and negative gradation voltages so that the center values respectively corresponds to the source drivers.

Thus, the center value between the positive and negative gradation voltages is adjusted for each driver so as to correspond to a slant of the charge pull-in amount ΔV in a direction of the gate signal line, thereby suppressing the flicker (1) without varying the gradation characteristic.

Further, in the flicker (2), also when a panel in-plane deviation of the charge pull-in amount ΔV caused by the plural-region divisional transfer of the pixel pattern is a horizontal direction deviation for example, the center value between the positive and negative gradation values is adjusted for each driver so as to correspond to the deviation of the charge pull-in amount ΔV in the transfer block, thereby suppressing the flicker (2) without varying the gradation characteristic.

Further, for example, the control section supplies the gradation voltage adjustment signal during a horizontal retrace line period, so that it is possible to set the center value between the positive and negative gradation voltages for each horizontal line or for every plural horizontal lines.

Thus, in the flicker (2), even when the panel in-plane deviation of the charge pull-in amount ΔV caused by the plural-region divisional transfer is a vertical direction deviation, the center value between the positive and negative gradation values is adjusted for each line or every plural lines in a single frame so as to correspond to the deviation of the charge pull-in amount ΔV in the transfer block, thereby suppressing the flicker (2) without varying the gradation characteristic.

Further, the charge pull-in amount ΔV has a deviation (deviation corresponding to each gradation voltage) corresponding to a value of a gradation voltage applied to a drain of the TFT. Thus, adjustment voltage generation circuits are provided on the gradation voltage generation circuit so as to respectively correspond to the gradations, and the adjustment voltage generation circuits respectively supply gradation voltage adjustment signals different from each other so as to respectively correspond to the gradations, and the center values each of which is a value between the positive and negative gradation voltages are independently adjusted. As a result, also in case where there is a deviation of the charge pull-in amount ΔV between the gradation voltages or in case where there is a deviation of the center value between the positive and negative gradation voltages which causes the flicker to be minimized between the gradation voltages, it is possible to suppress the flicker.

Further, in transmitting the gradation voltage adjustment signal, a special transmission line may be provided. However, if the video signal transmission line is used as the gradation voltage adjustment signal transmission line during a retrace line period, it is possible to reduce the special transmission line used exclusively to transmit the gradation voltage adjustment signal.

Note that, comparison between the liquid crystal display device disclosed in Patent Document 1 and the present invention shows that both the inventions are similar to each other in terms of the means for adjusting a gradation voltage.

However, the invention of Patent Document 1 and the present invention are different from each other in how the differential amplification circuit is used. Further, an object of Patent Document 1 is to easily adjust the gradation characteristic after designing the driving circuit, but an object of the present invention is to reduce the flicker in the entire panel plane without varying the gradation characteristic.

Further, according to Patent Document 1, when the gradation voltage is adjusted, a voltage difference between a positive voltage and a negative voltage varies, so that a charge pull-in amount of each gradation varies. This raises such problem that the variation of the charge pull-in amount causes greater flicker.

Further, Patent Document 1 does not mention how to input serial data for gradation voltage adjustment and a timing at which the serial data for gradation voltage adjustment is inputted.

The following Table 1 shows comparison between the present invention and Patent Document 1.

TABLE 1

| Item | Tokukai 2001-22325 | Present invention |
|---|---|---|
| Object | Adjustment of gradation characteristic | Reduction of a flicker in a panel plane. |
| Gradation voltage adjustment means | Amplitude values of positive and negative gradation voltages are varied. | Amplitude values of positive and negative gradation voltages are fixed and only a center value is varied. |
| How to input gradation voltage adjustment data | None is mentioned. | How to input serial data and a timing at which the serial data is inputted are described. Also a method which allows transmission without adding any data line is described. |

The foregoing description shows that Patent Document 1 and the present invention are completely different from each other in terms of an arrangement.

As described above, according to the present invention, in the liquid crystal display, a gradation voltage adjustment section is provided on a gradation voltage generation circuit, and a positive gradation voltage VHX of an X-th gradation and a negative gradation voltage VLX of the X-th gradation are simultaneously increased so that the increment corresponds to a charge pull-in amount ΔV, so that it is possible to suppress the flicker in the entire panel plane without varying the gradation characteristic, thereby realizing a favorable display condition.

BEST MODE FOR CARRYING OUT THE INVENTION

With reference to the drawings, the following description explains Embodiments 1 to 3 each of which discloses (i) a liquid crystal display device of the present invention and (ii) a liquid crystal display driving circuit used in the liquid crystal display device.

Embodiment 1

Figure 1:
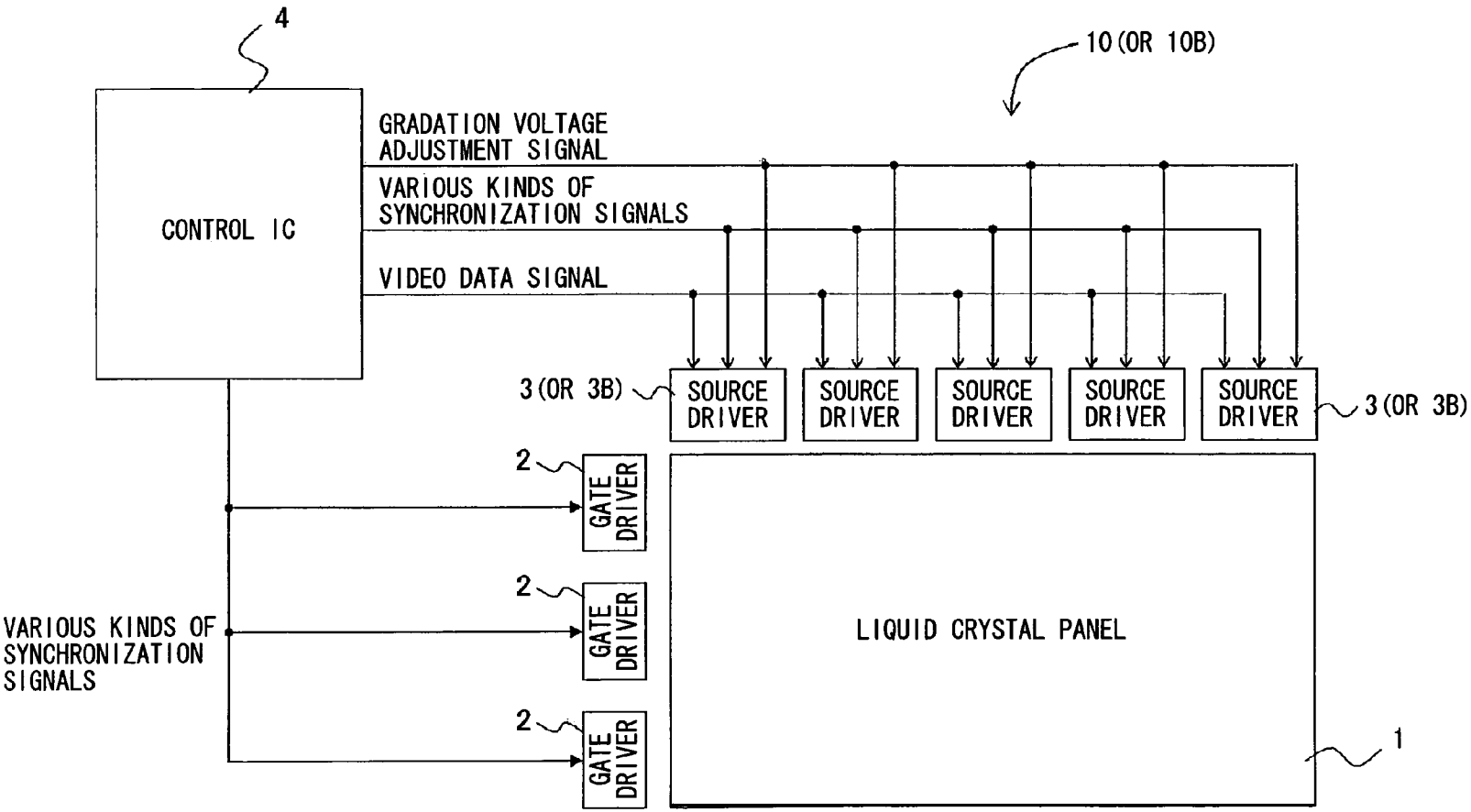
FIG. 1 is a block diagram illustrating an example of an arrangement of a liquid crystal display device according to Embodiment 1 of the present invention.

FIG. 1 is a block diagram illustrating an example of an arrangement of a liquid crystal display device according to Embodiment 1 of the present invention.

In FIG. 1, a liquid crystal display device 10 includes a liquid crystal panel 1, a plurality of gate drivers 2, a plurality of source drivers 3, and a control IC (control section) 4 for outputting a video data signal and control signals for controlling the gate drivers 2 and the source drivers 3.

The liquid crystal panel 1 is arranged so that: a plurality of scanning signal lines (gate signal lines) and a plurality of video signal lines (source signal lines) are provided so as to intersect with each other, and a plurality of display pixel sections are disposed in a matrix manner so that each of the display pixel sections is positioned in each of pixel areas (each of pixel sections) sectioned by both the signal lines and is connected to each gate signal line and each source signal line.

The gate drivers 2 are provided in a vicinity of the liquid crystal panel 1 so as to correspond to a plural number (predetermined number) of gate signal lines, and a scanning signal (gate signal) for selectively driving each pixel section connected to a corresponding gate signal line is selectively supplied to the gate signal line.

The source drivers 3 are provided in a vicinity of the liquid crystal panel 1 so as to correspond to a plural number (predetermined number) of source signal lines, and a positive or negative gradation voltage corresponding to a video display of each display pixel section connected to a corresponding source signal line is selectively supplied to the source signal line as a video signal (source signal). This allows inversion driving of the liquid crystal panel 1.

A control IC4 supplies to the gate driver 2 various kinds of synchronization signals such as a clock signal CK, a start pulse SP, and the like, and supplies to the source driver 3 (i) various kinds of synchronization signals such as a clock signal CK, a start pulse SP, a latch signal LS, and the like, (ii) RGB video data signals DR, DG, and DB, and (iii) a gradation voltage adjustment signal DV for adjusting a gradation voltage.

In the liquid crystal display device 10, the source driver 3 and the gate driver 2 are driven by the various kinds of synchronization signals outputted from the control IC4, so that a video based on the video data signal is displayed in the liquid crystal panel 1 constituting the display section.

In Embodiment 1, each source driver 3 has a function for carrying out voltage adjustment by a gradation voltage adjustment signal DV supplied from the control IC4 so that gradation voltage values of an arbitrary gradation (a positive gradation voltage VHX of an X-th gradation and a negative gradation voltage VLX of the X-th gradation) are increased so that the increment corresponds to the charge pull-in amount ΔV (hereinafter, this function is referred to as "gradation voltage adjustment function").

As a result, even when the gate signal has a round waveform which results in variation of the charge pull-in voltage ΔV in each pixel section, it is possible to suppress the flicker by carrying out the voltage adjustment with respect to a center value between the gradation voltages with each source driver 3. Further, even when plural-region divisional transfer results in a horizontal direction deviation of the charge pull-in amount ΔV for example, it is possible to suppress the flicker by carrying out the voltage adjustment with respect to a center value between the gradation voltages according to the horizontal direction slant of the charge pull-in amount ΔV. This is detailed as follows with reference to FIGS. 2 to 4.

Figure 2:
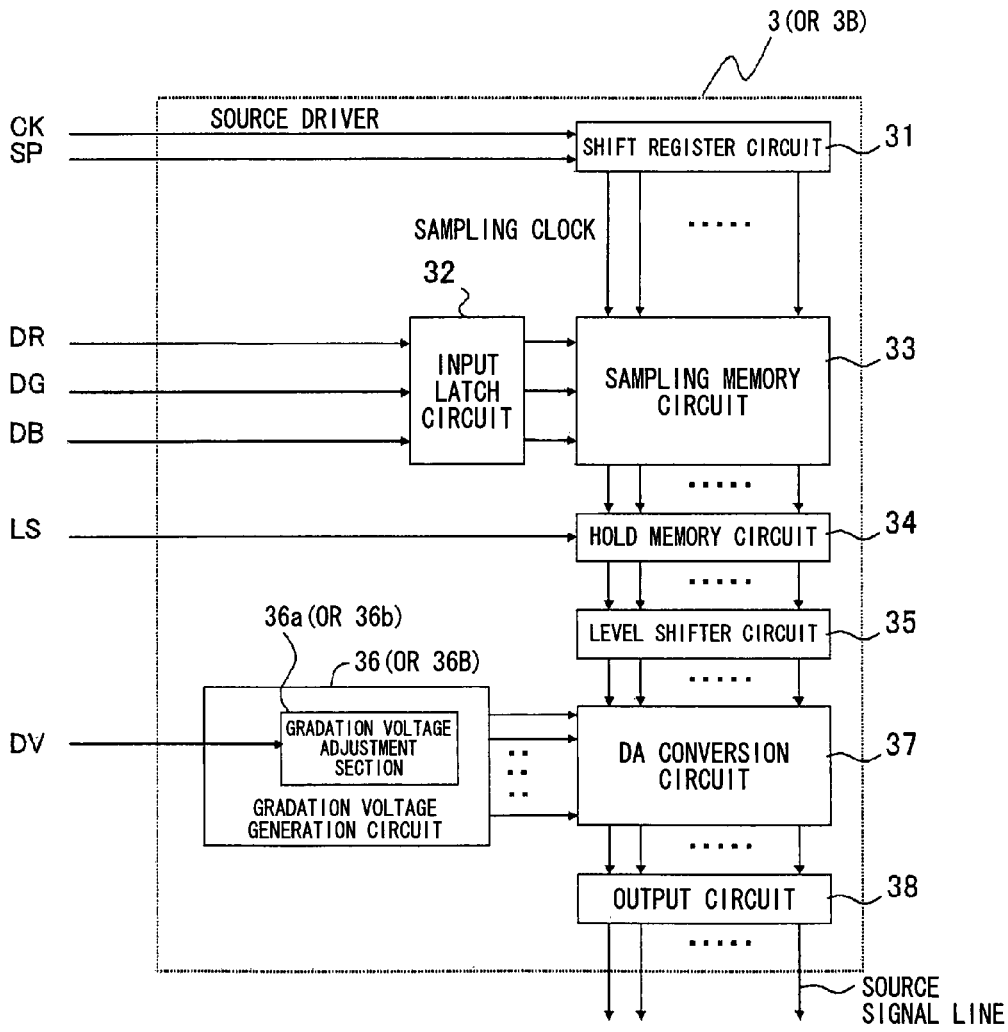
FIG. 2 is a block diagram illustrating an example of an arrangement of a source driver of the liquid crystal display device illustrated in FIG. 1.

FIG. 2 is a block diagram illustrating an example of an arrangement of the source driver 3 of the liquid crystal display device 10 illustrated in FIG. 1.

In FIG. 2, the source driver 3 includes a shift register circuit 31, an input latch circuit 32, a sampling memory circuit 33, a hold memory circuit 34, a level shifter circuit 35, a gradation voltage generation circuit (gradation voltage generation section) 36, a DA (digital/analog) conversion circuit 37, and an output circuit 38, as in a generally used source driver.

The shift register circuit 31 receives the clock signal CK and the start pulse SP from the control IC4, generates a sampling clock for each source signal line, and supplies thus generated sampling clock to the sampling memory circuit 33.

The input latch circuit 32 latches the video data signals DR, DG, and DB from the control IC4.

The sampling memory circuit 33 samples the video data signals DR, DG, and DB, which have been latched by the input latch circuit 32, at a timing of the sampling clock supplied from the shift register circuit 31.

In the hold memory circuit 34, a video data signal (sampling data) corresponding to a single horizontal line which video data signal is supplied from the sampling memory 33 is latched and held at a timing of the latch signal LS supplied from the control IC4.

The level shifter circuit 35 receives the video data signal (sampling data) supplied from the hold memory circuit 34 and shifts a level of the video data signal so that the shift correspond to a predetermined amount.

The gradation voltage generation circuit 36 can generate a plurality of gradation voltages required in multiple gradation display, and the gradation voltages are supplied to the DA conversion circuit 37. In Embodiment 1, the gradation voltage generation circuit 36 has an adjustment voltage adjustment section 36*a* which outputs an adjustment voltage Va for adjusting a gradation voltage according to the gradation voltage adjustment signal DV supplied from the control IC4. The adjustment voltage Va serves as a voltage for carrying out voltage adjustment so that gradation voltage values of an arbitrary gradation (a positive gradation voltage VHX of an X-th gradation and a negative gradation voltage VLX of the X-th gradation) are increased so that the increment corresponds to the charge pull-in amount ΔV. This is detailed as follows with reference to FIG. 3 and FIG. 4.

The DA conversion circuit 37 carries out DA conversion of the gradation voltage, supplied from the gradation voltage generation circuit 36, according to the video data signal supplied from the level shifter circuit 35, so as to supply the converted gradation voltage to the output circuit 38.

The output circuit 38 outputs the DA-converted gradation voltage, supplied from the DA conversion circuit 37, to each source signal line as a display voltage.

Figure 3:
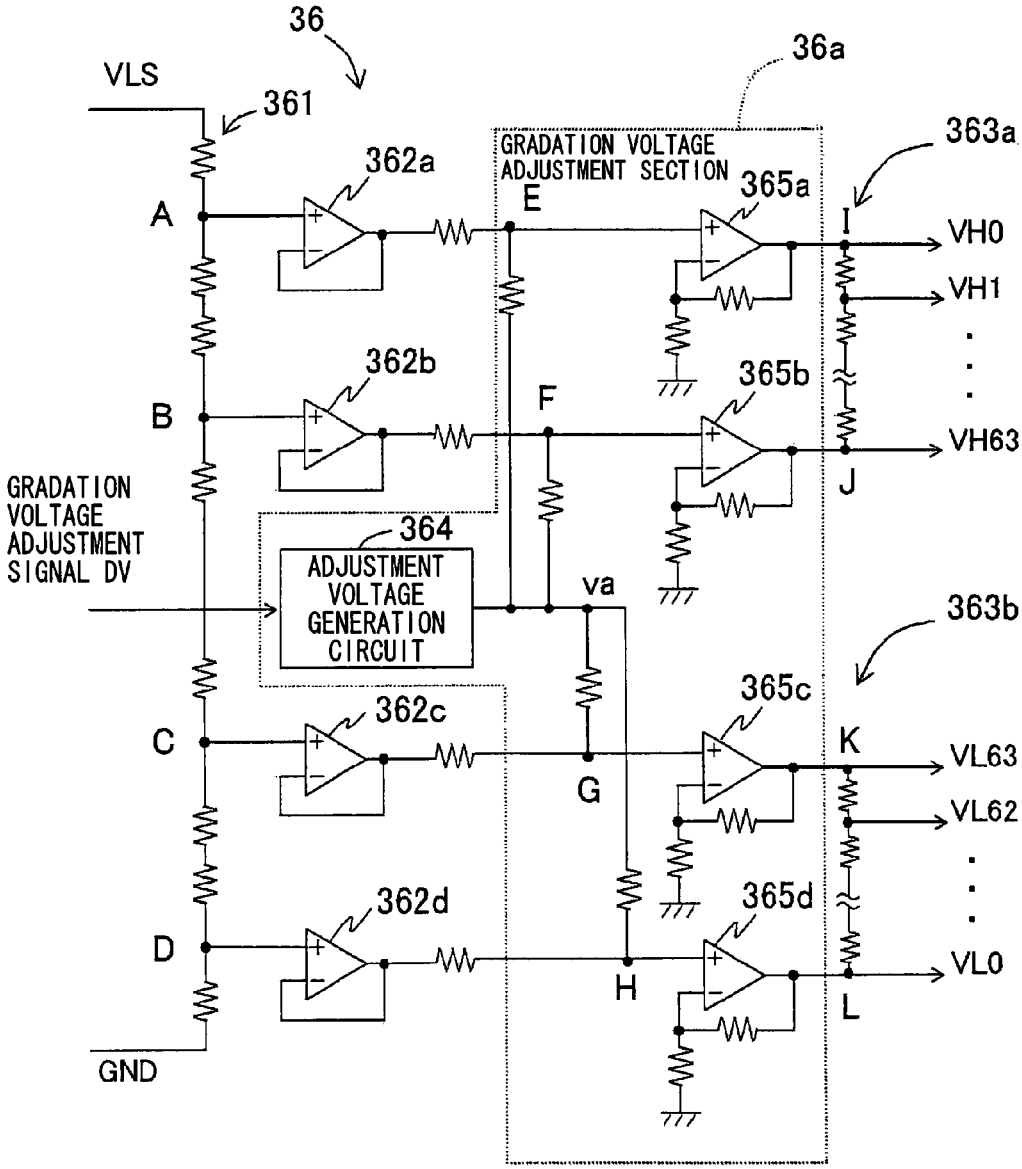
FIG. 3 is a circuit diagram illustrating an example of an arrangement of a gradation voltage generation circuit of the source driver illustrated in FIG. 2.

FIG. 3 is a circuit diagram illustrating an example of an arrangement of the gradation voltage generation circuit 36 of the source driver 3 illustrated in FIG. 2.

In FIG. 3, the gradation voltage generation circuit 36 is obtained by adding the gradation voltage adjustment section 36*a* to a generally used gradation voltage generation circuit, and includes: a first voltage dividing circuit 361 for generating plural positive or negative reference voltages (resistance division voltages in points A to D) in accordance with a positive standard voltage VLS and a negative standard voltage GND; buffers 362*a* to 362*d* each of which temporarily stores each reference voltage; a second voltage dividing circuit 363*a* for generating positive gradation voltages VH0 to VH63 through resistance division by using positive reference voltages (resistance division voltages in points A and B); a third voltage dividing circuit 363*b* for generating negative gradation voltages VL63 to VL0 by using negative reference voltages (resistance division voltages in points C and D); and the voltage gradation voltage adjustment section 36*a* for outputting the adjustment voltage Va corresponding to the charge pull-in amount ΔV so that the adjustment voltage Va is added to each of the reference voltages (resistance division voltages in the points A to D).

A positive input terminal of the buffer 362*a* is connected to the point A of a first voltage dividing circuit 361, and a negative input terminal of the buffer 362*a* is connected to an output terminal of the buffer 362*a*, and a positive input terminal of the buffer 362*b* is connected to the point B of the first voltage dividing circuit 361, and a negative input terminal of the buffer 362*b* is connected to an output terminal of the buffer 362*b*. Each of the buffers 362*a* and 362*b* outputs a positive reference voltage. Further, a positive input terminal of the buffer 362*c* is connected to the point C of the first voltage dividing circuit 361, and a negative input terminal of the buffer 362*c* is connected to the output terminal of the buffer 362*c*, and a positive input terminal of the buffer 362*d* is connected to the point D of the first voltage dividing circuit 361, and a negative input terminal of the buffer 362*d* is connected to the output terminal of the buffer 362*d*. Each of the buffers 362*c* and 362*d* outputs a negative reference voltage.

The gradation voltage adjustment section 36*a* includes: an adjustment voltage generation circuit 364 for generating the adjustment voltage Va according to a gradation voltage adjustment signal DV supplied from the control IC4; and differential amplification circuits 365*a* to 365*d* each of which has a positive input terminal connected to the output terminal of each of the buffers 362*a* to 362*d* and to an output terminal of the adjustment voltage generation circuit 364 and has a negative input terminal grounded, wherein the positive input terminal of each of the differential amplification circuits 365*a* to 365*d* receives the adjustment voltage Va for carrying out voltage adjustment so as to increase the gradation voltage so that the increment from the reference voltage of the output terminal of each of the buffers 362*a* to 362*d* corresponds to the charge pull-in amount ΔV.

Figure 4:
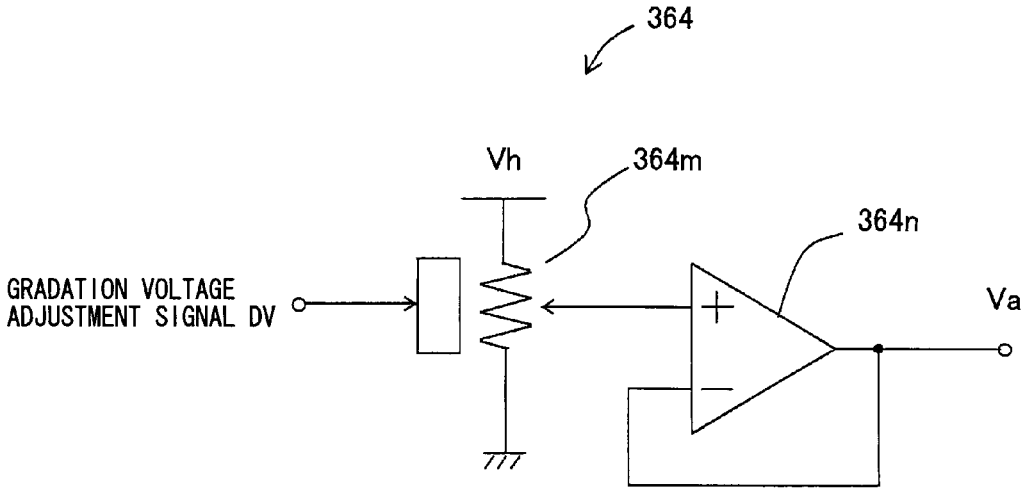
FIG. 4 is a circuit diagram illustrating an example of an arrangement of the gradation voltage generation circuit illustrated in FIG. 3.

FIG. 4 is a circuit diagram illustrating an example of an arrangement of the adjustment voltage generation circuit 364 illustrated in FIG. 3.

As illustrated in FIG. 4, the adjustment voltage generation circuit 364 includes: a variable resistance element 364*m* whose resistance value is variable according to the gradation voltage adjustment signal DV; and a buffer 364*n* serving as buffer means whose positive input terminal is connected to an output of the variable resistance element 364*m* and negative input terminal is connected to an output terminal of the variable resistance element 364*m*. As the variable resistance element 364, it is preferable to use a potentiometer which can obtain a desired resistance value by inputting serial data. The following description explains a case where the potentiometer is used as the variable resistance element 364*m*.

With reference to FIG. 3 again, the differential amplification circuit 365*a* of the gradation voltage adjustment section 36*a* is explained. A positive input terminal of the differential amplification circuit 365*a* is connected to a junction E between the output terminal of the adjustment voltage generation circuit 364 and the output terminal of the buffer 362*a*, and a negative input terminal of the differential amplification circuit 365*a* is grounded via a resistor. Further, a positive input terminal of the differential amplification circuit 365*b* is connected to a junction F between the output terminal of the adjustment voltage generation circuit 364 and the output terminal of the buffer 362*b*, and a negative input terminal of the differential amplification circuit 365*b* is grounded via a resistor. Further, a positive input terminal of the differential amplification circuit 365*c* is connected to a junction G between the output terminal of the adjustment voltage generation circuit 364 and the output terminal of the buffer 362*c*, and a negative input terminal of the differential amplification circuit 365*c* is grounded via a resistor. Further, a positive input terminal of the differential amplification circuit 365*d* is connected to a junction H between the output terminal of the adjustment voltage generation circuit 364 and the output terminal of the buffer 362*d*, and a negative input terminal of the differential amplification circuit 365*d* is grounded via a resistor. Further, resistors are provided between the output terminal of the adjustment voltage generation circuit 364 and the junctions E to H respectively, resistors provided between the output terminals of the buffers 362*a* to 362*d* and the junctions E to H respectively, and resistors are provided between the output terminals of the differential amplification circuits 365*a* to 365*d* and the negative input terminals of the differential amplification circuits 365*a* to 365*d* respectively.

In the second voltage dividing circuit 363*a*, the output terminal of the differential amplification circuit 365*a* is connected to a point I via which a maximum gradation voltage VH0 having a positive polarity with respect to a counter voltage Vcom is outputted, and the output terminal of the differential amplification circuit 365*b* is connected to a point J via which a minimum gradation voltage VH63 having a positive polarity is outputted.

Further, in the third voltage dividing circuit 363*b*, the output terminal of the differential amplification circuit 365*c* is connected to a point K via which a maximum gradation voltage VL63 having a negative polarity with respect to the counter voltage Vcom is outputted, and the output terminal of the differential amplification circuit 365*d* is connected to an L point via which a minimum gradation voltage VL0 having a negative polarity is outputted.

As a result, out of the gradation voltages having positive polarities with respect to the counter voltage Vcom, the gradation voltage VH0 whose voltage value is maximum and the gradation voltage VH63 whose voltage value is minimum are adjusted. Further, out of the gradation voltages having negative polarities with respect to the counter voltage Vcom, the gradation voltage VL63 whose voltage value is maximum and the gradation voltage VL0 whose voltage value is minimum are adjusted.

In this manner, the gradation voltage adjustment section 36*a* shifts a minimum value (gradation voltage VH63) and a maximum value (gradation voltage VH0) of a gradation voltage range (VH63 to VH0) including a positive gradation voltage VHX of an arbitrary X-th gradation therebetween so that the minimum value and the maximum value are increased so that the increment corresponds to the charge pull-in amount ΔV (adjustment voltage Va) and also shifts a minimum value (gradation voltage VH0) and a maximum value (gradation voltage VH63) of a gradation voltage range (VH0 to VH63) including a negative gradation voltage VLX of an arbitrary X-th gradation therebetween so that each of the minimum value and the maximum value are increased so that the increment corresponds to the charge pull-in amount ΔV (adjustment voltage Va), thereby keeping a voltage difference between a positive voltage and a negative voltage in each gradation and varying a center voltage between the positive voltage and the negative voltage so that the center value becomes higher by the charge pull-in amount ΔV (adjustment voltage Va).

Based on the arrangement, the following description explains how the gradation voltage generation circuit 36 of Embodiment 1 operates.

In the adjustment voltage generation circuit 364 illustrated in FIG. 4, a resistance value of the variable resistance element 364*a* is controlled by the gradation voltage adjustment signal DV, and the gradation voltage Va is outputted via the buffer 364*n*. In this manner, the adjustment voltage generation circuit 364 selectively outputs voltage values ranging from Vh to 0V as the adjustment voltage Va in accordance with the gradation voltage adjustment signal DV.

Further, in each of the differential amplification circuits 365*a* to 365*d* illustrated in FIG. 3, each of the gradation voltages VH0, VH63, VL63, and VL0 is made higher by the output adjustment voltage Va outputted from the adjustment voltage generation circuit 364, and the increased gradation voltage is outputted therefrom. As a result, the gradation voltages VH0, VH63, VL0, and VL63 are evenly shifted so that each of the gradation voltages becomes higher by the adjustment voltage Va (charge pull-in amount ΔV) generated by the adjustment voltage generation circuit 364, so that a voltage difference between a positive voltage and a negative voltage in each gradation is kept. As a result, it is possible to vary only a center potential (hereinafter, referred to as "center value") between the positive voltage and the negative voltage. For example, difference of the gradation voltages VH20–VL20 are kept at the same state as in voltages which have not been adjusted, so that it is possible to vary only the center value between the gradation voltages VH20 and VL20 without varying the gradation characteristic thereof.

The gradation voltage generation circuit 36 is provided for each source driver 3, and the control IC4 supplies gradation voltage adjustment signals DV which are different from each other so as to correspond to the source drivers 3 respectively, so that it is possible to set center values each of which is a value between the positive and negative gradation voltages so that the center values respectively correspond to the source drivers 3.

Thus, according to Embodiment 1, for each gate driver 3, each of a positive gradation voltage and a negative gradation voltage is increased, by a charge pull-in amount ΔV of a pixel section connected to a corresponding source signal line, in accordance with a slant of a charge pull-in amount ΔV in a direction of the gate scanning signal line which slant causes the flicker (1), so as to adjust a center value between the positive and negative gradation voltages, thereby reducing the flicker (1) without varying the gradation characteristic thereof.

Further, according to Embodiment 1, in case where a panel in-plane deviation of a charge pull-in amount ΔV resulting from plural-region divisional transfer which causes the flicker (2) is a horizontal direction deviation, for each gate driver 3, each of a positive gradation voltage and a negative gradation voltage is increased, by a charge pull-in amount ΔV of a pixel section connected to a corresponding source signal line, in accordance with the horizontal direction deviation of the charge pull-in amount ΔV in the transfer block, so as to adjust a center value between the positive and negative gradation voltages, thereby reducing the flicker (2) without varying the gradation characteristic thereof.

Figure 5:
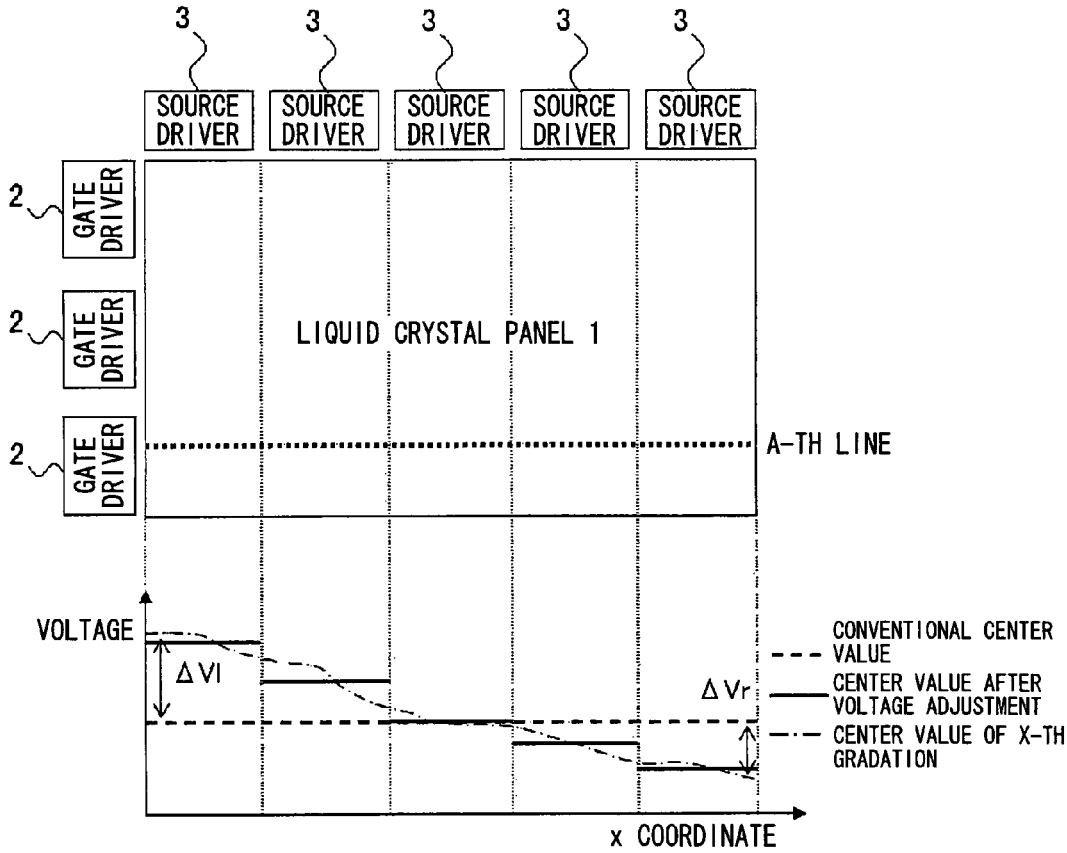
FIG. 5 is a diagram illustrating how to reduce a flicker caused by a horizontal direction deviation of a charge pull-in amount ΔV in Embodiment 1 of the present invention.

With reference to FIG. 5, the following description details a state in which it is possible to correct the horizontal direction slant of the charge pull-in amount ΔV in reducing the flicker caused by the horizontal direction slant of the charge pull-in amount ΔV in the liquid crystal display device 10 of Embodiment 1.

FIG. 5 illustrates gradation voltage values in a horizontal direction (x direction) of the liquid crystal panel 1.

Consider the following case: in an A-th line of FIG. 5, a center value between positive and negative gradation voltages each of which causes the flicker to be minimized is on a dashed line of FIG. 5.

In the conventional liquid crystal display device having no gradation voltage adjustment function, it is impossible to realize adjustment other than such adjustment that the flicker is not recognized with eyes in any one point of the display screen of the liquid crystal panel 1. Thus, as illustrated by a dotted line of FIG. 5, when the adjustment is carried out in a center portion of the panel, the positive voltage and the negative voltage become unbalanced by ΔV1 and ΔVr which are respectively in a left side and a right side of FIG. 5, so that the flicker occurs.

In contrast, according to the liquid crystal display device 10 of Embodiment 1 in which the gradation voltage adjustment function is provided for each source driver 3, as illustrated in a continual line of FIG. 5, it is possible to set the center value between the positive and negative gradation voltages to be an optimal value for each source driver 3, so that it is possible to greatly reduce the flicker.

In Embodiment 1, as described above, the present invention is not limited to the arrangement in which the center value between the positive and negative gradation voltages is set to an optimal value for each source driver 3. For example, it may be so arranged that: the control IC4 supplies the gradation voltage adjustment signal DV to the adjustment voltage adjustment section 36*a* in a horizontal retrace line period, thereby setting the center value between the positive and negative gradation voltages for each horizontal line or every plural horizontal lines within a single frame.

As a result, even when a panel in-plane deviation of the charge pull-in amount ΔV resulting from the plural-region divisional transfer causing the flicker (2) is a vertical direction deviation, each of the positive and negative gradation voltages is increased for each horizontal line or every plural horizontal lines within a single frame, by a charge pull-in amount ΔV of the pixel section connected to a corresponding gate signal line, in accordance with a vertical direction charge pull-in amount ΔV in a transfer block, so as to adjust the center value between the positive and negative gradation voltages, thereby reducing the flicker (2) without varying the gradation characteristic thereof.

Figure 6:
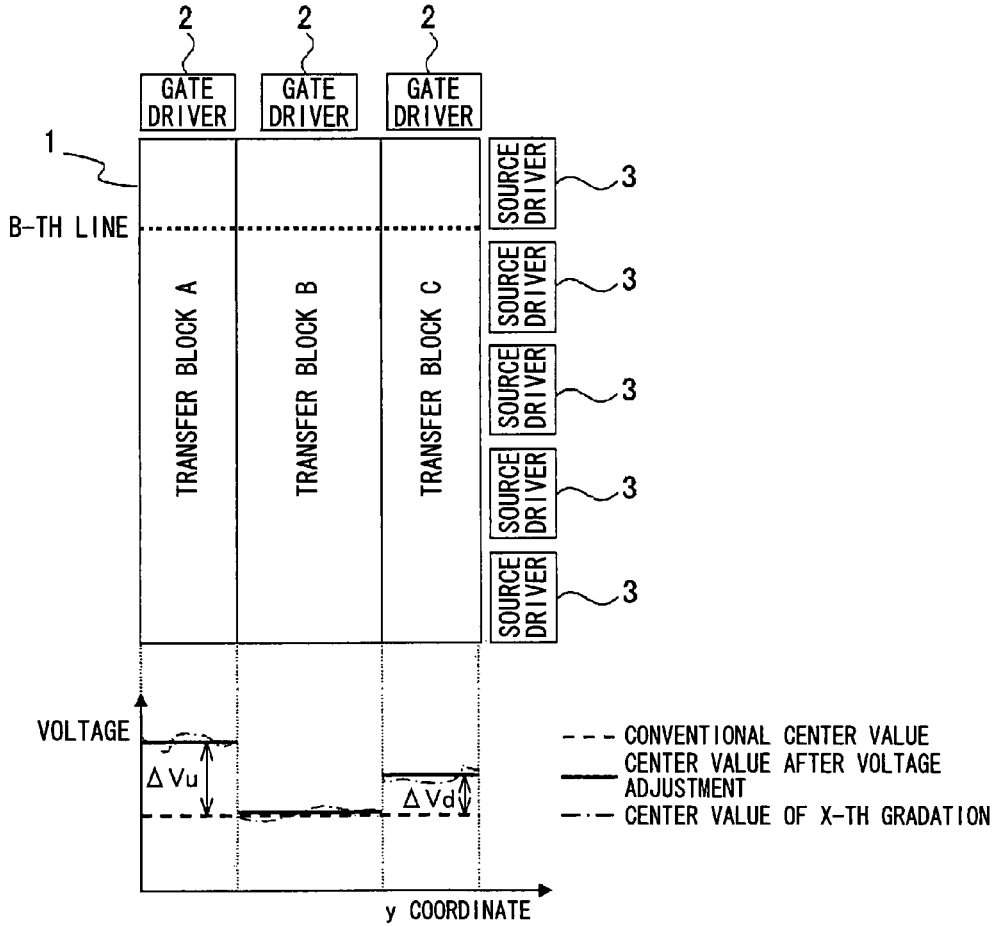
FIG. 6 is a diagram illustrating how to reduce a flicker caused by a vertical direction slant of the charge pull-in amount ΔV in Embodiment 1 of the present invention.

With reference to FIG. 6, the following description details a state in which it is possible to correct the vertical direction slant of the charge pull-in amount ΔV in reducing the flicker caused by the vertical direction slant of the charge pull-in amount ΔV in the liquid crystal display device 10 of Embodiment 1.

FIG. 6 illustrates gradation voltage values in a vertical direction (y direction) of the liquid crystal panel 1.

Consider the following case: in a B-th line of FIG. 6, a center value between positive and negative gradation voltages each of which causes the flicker to be minimized is on a dashed line of FIG. 6.

In the conventional liquid crystal display device having no gradation voltage adjustment function, it is impossible to realize adjustment other than such adjustment that the flicker is not recognized with eyes in any one point of the display screen of the liquid crystal panel 1. Thus, as illustrated by a dotted line of FIG. 6, when the adjustment is carried out in a center potion of the panel, the positive voltage and the negative voltage become unbalanced by ΔVu and ΔVd which are respectively in area different from each other in the transfer block of FIG. 6, so that the flicker occurs.

In contrast, according to the liquid crystal display device 10 of Embodiment 1 in which it is possible to vary the center value between the positive and negative gradation voltages for each horizontal line or every plural horizontal lines within a single frame, as illustrated in a continual line of FIG. 6, it is possible to set the center value between the positive and negative gradation voltages to be an optimal value, so that it is possible to greatly reduce the flicker. This may be arranged as follows: for example, the center value between the positive and negative gradation voltages is set to be an optimal value for each gate driver 2.

As described above, according to Embodiment 1, the liquid crystal display device 10 has a structure which allows voltage adjustment of the center value between the positive and negative gradation voltages for each source driver 3 or each horizontal line or every plural horizontal lines, so that it is possible to reduce the flicker of the entire panel face without varying the gradation characteristic thereof.

Further, the control IC4 for controlling the voltage adjustment functions as means for setting an amount by which the center value is shifted in accordance with the pixel section driven in the liquid crystal panel.

Embodiment 2

The charge pull-in amount ΔV has a deviation in the panel face, so that there is a deviation (deviation in each gradation voltage) with respect to a value of a gradation voltage applied to a drain region of the TFT element. Generally, the deviation is referred to as "ω value". As in Embodiment 1, all the gradation voltages VH0, VH63, VL0, and VL36 are increased/adjusted by the adjustment voltage Va having the same potential, thereby reducing the flicker. However, by making it possible also to correct the ω value with a gradation voltage adjustment function which allows the gradation voltage adjustment to be carried out more freely, it is possible to further greatly reduce the flicker.

Embodiment 2 will describe a liquid crystal display device 10B by which it is possible to correct the ω value which is a deviation in each gradation voltage.

Figure 7:
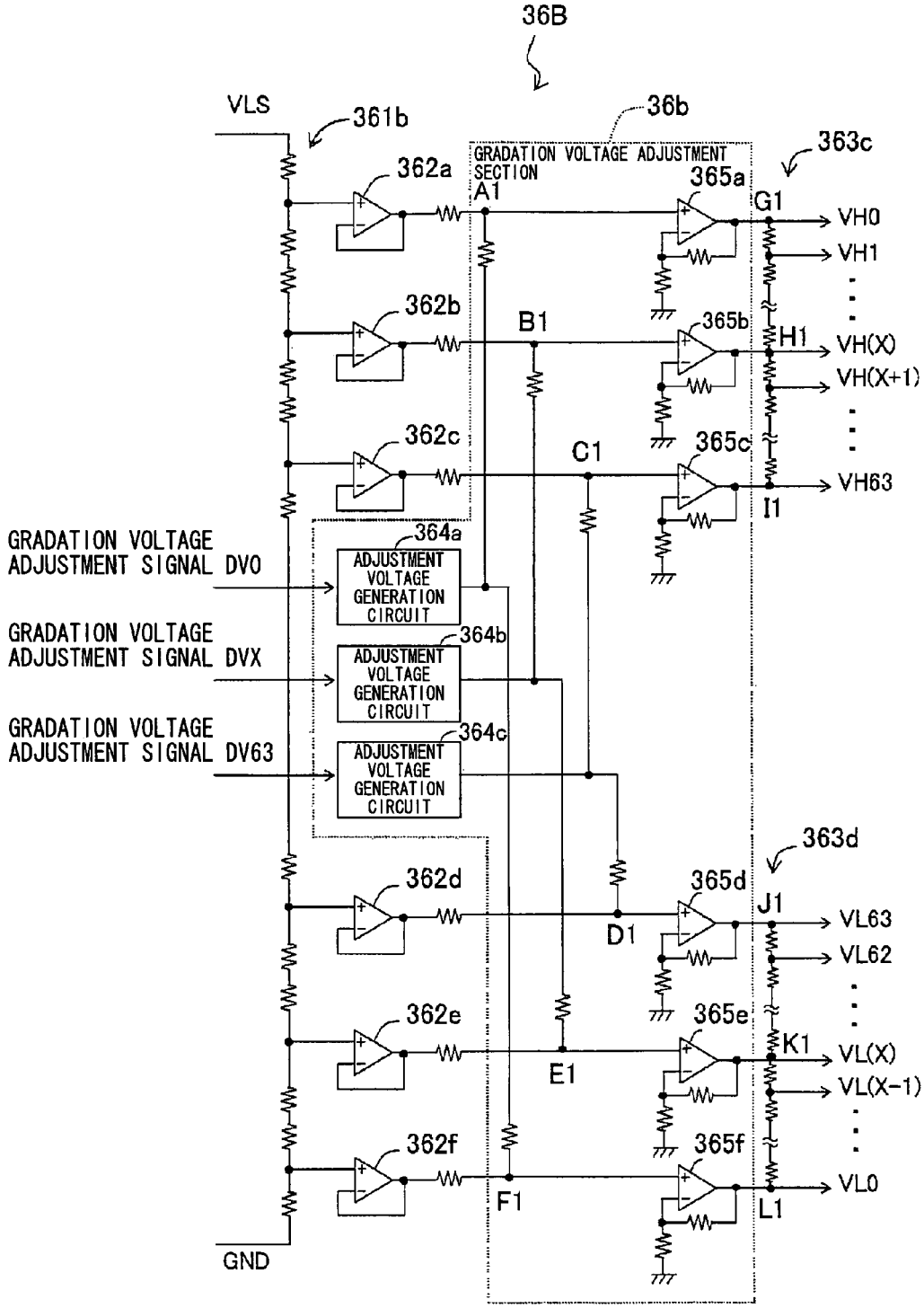
FIG. 7 is a circuit diagram illustrating an example of an arrangement of a gradation voltage generation circuit of a liquid crystal display device of Embodiment 2 of the present invention.

FIG. 7 is a circuit diagram illustrating an example of an arrangement of a gradation voltage generation circuit 36B of a liquid crystal display device 10B (see FIG. 1) of Embodiment 2 of the present invention.

In FIG. 7, the gradation voltage generation circuit 36B includes: a fourth voltage dividing circuit 361*b* for generating a plurality of positive and negative reference voltages (predetermined reference voltages) in accordance with positive and negative reference voltages VLS and GND; buffers 362*a* to 362*f* for temporarily storing the plural reference voltages; adjustment voltage generation circuits 364*a* to 364*c* for generating adjustment voltages each of which is independence so as to correspond to each gradation in accordance with gradation voltage adjustment signals DV0, DVX, and DV63 supplied from the control IC4; differential amplification circuits 365*a* to 365*f* each of which differentially amplifies a value obtained by adding an adjustment voltage from any one of the adjustment voltage generation circuits 364*a* to 364*c* to an output voltage from any one of the buffers 362*a* to 362*f*; a fifth voltage dividing circuit 363*c* for generating positive gradation voltages VH0 to VH63 by using positive reference voltages; and a sixth voltage dividing circuit 363*d* for generating negative gradation voltages VL63 to VL0 by using negative reference voltages. These voltage generation circuits 364*a* to 364*c* and the differential amplification circuits 365*a* to 365*f* constitute the gradation voltage adjustment section 36*d*.

The adjustment voltage generation circuits 364*a* to 364*c* do not vary the gradation characteristic. Thus, as in the case of the adjustment voltage generation circuit 364 of FIG. 3, each of a positive gradation voltage and a negative gradation voltage which correspond to the same gradation is increased so that the increment corresponds to the same voltage value (charge pull-in amount ΔV) at the time of gradation voltage adjustment, and a center value between the positive and negative gradation voltages is adjusted while keeping a voltage difference between the positive gradation voltage and the negative gradation voltage at a constant value. For example, a positive voltage VH(X) and a negative voltage VL(X) of an arbitrary X-th gradation, each of VH(X) and VL(X) is increased so that the increment corresponds to the output adjustment voltage Va while fixing a voltage value of VH(X)-VL(X) at a constant value, thereby varying only a center value between VH(X) and VL(X).

A positive input terminal of the differential amplification circuit 365*a* is connected to a junction A1 between (i) an output terminal of the adjustment voltage generation circuit 364*a* and (ii) an output terminal of the buffer 362*a* from which a positive maximum reference voltage is outputted, and a negative input terminal of the differential amplification circuit 365*a* is grounded via a resistor. Further, a positive input terminal of the differential amplification circuit 365*b* is connected to a junction B1 between (i) an output terminal of the adjustment voltage generation circuit 364*b* and (ii) an output terminal of the buffer 362*b* from which a positive intermediate reference voltage is outputted, and a negative input terminal of the differential amplification circuit 365*b* is grounded via a resistor. Further, a positive input terminal of the differential amplification circuit 365*c* is connected to a junction C1 between (i) an output terminal of the adjustment voltage generation circuit 364*c* and (ii) an output terminal of the buffer 362*c* from which a positive minimum reference voltage is outputted, and a negative input terminal of the differential amplification circuit 365*c* is grounded via a resistor.

Further, a positive input terminal of the differential amplification circuit 365*d* is connected to a junction D1 between (i) an output terminal of the adjustment voltage generation circuit 364*c* and (ii) an output terminal of the buffer 362*d* from which a negative maximum reference voltage is outputted, and a negative input terminal of the differential amplification circuit 365*d* is grounded via a resistor. Further, a positive input terminal of the differential amplification circuit 365*e* is connected to a junction E1 between (i) an output terminal of the adjustment voltage generation circuit 364*b* and (ii) an output terminal of the buffer 362*e* from which a negative intermediate reference voltage is outputted, and a negative input terminal of the differential amplification circuit 365*e* is grounded via a resistor. Further, a positive input terminal of the differential amplification circuit 365F is connected to a junction F1 between (i) an output terminal of the adjustment voltage generation circuit 364*a* and (ii) an output terminal of the buffer 362*f* from which a negative maximum reference voltage is outputted, and a negative input terminal of the differential amplification circuit 365F is grounded via a resistor.

Further, a resistor is provided between the output terminal of the adjustment voltage generation circuit 364*a* and the junction A, and a resistor is provided between the output terminal of the adjustment voltage generation circuit 364*b* and the junction B, and a resistor is provided between the output terminal of the adjustment voltage generation circuit 364*c* and the junction C, and a resistor is provided between the output terminal of the adjustment voltage generation circuit 364*c* and the junction D, and a resistor is provided between the output terminal of the adjustment voltage generation circuit 364*b* and the junction E, and a resistor is provided between the output terminal of the adjustment voltage generation circuit 364*a* and the junction F. A resistor is provided between the output terminal of the buffer 362*a* and the junction A, and a resistor is provided between the output terminal of the buffer 362*b* and the junction B, and a resistor is provided between the output terminal of the buffer 362*c* and the junction C, and a resistor is provided between the output terminal of the buffer 362*d* and the junction D, and a resistor is provided between the output terminal of the buffer 362*e* and the junction E, and a resistor is provided between the output terminal of the buffer 362*f* and the junction F. A resistor is provided between the output terminal of the differential amplification circuit 365*a* and the negative input terminal of the differential amplification circuit 365*a*, and a resistor is provided between the output terminal of the differential amplification circuit 365*b* and the negative input terminal of the differential amplification circuit 365*b*, and a resistor is provided between the output terminal of the differential amplification circuit 365*c* and the negative input terminal of the differential amplification circuit 365*c*, and a resistor is provided between the output terminal of the differential amplification circuit 365*d* and the negative input terminal of the differential amplification circuit 365*d*, and a resistor is provided between the output terminal of the differential amplification circuit 365*e* and the negative input terminal of the differential amplification circuit 365*e*, and a resistor is provided between the output terminal of the differential amplification circuit 365*f* and the negative input terminal of the differential amplification circuit 365*f*.

In the fifth voltage dividing circuit 363*c*, the output terminal of the differential amplification circuit 365*a* is connected to a point G1 via which a maximum gradation voltage VH0 having a positive polarity with respect to the counter voltage Vcom is outputted, and the output terminal of the differential amplification circuit 365*b* is connected to a point H1 via which an intermediate gradation voltage VH(X) having a positive polarity with respect to the counter voltage Vcom is outputted, and the output terminal of the differential amplification circuit 365*c* is connected to a point I1 via which a minimum gradation voltage VH63 having a positive polarity with respect to the counter voltage Vcom is outputted.

Further, in the sixth voltage dividing circuit 363*d*, the output terminal of the differential amplification circuit 365*d* is connected to a point J1 via which a maximum gradation voltage VL63 having a negative polarity with respect to the counter voltage Vcom is outputted, and the output terminal of the differential amplification circuit 365*e* is connected to a point K1 via which an intermediate gradation voltage VL(X) having a negative polarity with respect to the counter voltage Vcom is outputted, and the output terminal of the differential amplification circuit 365*f* is connected to a point L1 via which a minimum gradation voltage VL0 having a positive polarity with respect to the counter voltage Vcom is outputted.

As a result, out of the gradation voltages having positive polarities with respect to the counter voltage Vcom, the gradation voltage VH0 whose voltage value is maximum, the gradation voltage VH(X) whose voltage value is intermediate, and the gradation voltage VH63 whose voltage value is minimum are adjusted for each gradation. Further, out of the gradation voltages having negative polarities with respect to the counter voltage Vcom, the gradation voltage VL63 whose voltage value is maximum, the gradation voltage VL(X) whose voltage value is intermediate, and the gradation voltage VL0 whose voltage value is minimum are adjusted for each gradation.

As described above, according to Embodiment 2, it is possible to adjust the center value between the positive and negative gradation voltages independently for each gradation. Thus, also in case where there is a deviation (ω value) among gradations in terms of the charge pull-in amount ΔV or in case where there is a deviation (ω value) among gradations in terms of the center value between the positive and negative gradation voltages each of which minimizes the flicker, the gradation voltage adjustment signals DV0, DVX, and DV63 which are different from one another are inputted so as to respectively correspond to the gradations, thereby further reducing the flicker.

Further, the control IC4 for controlling the voltage adjustment functions as the means for setting a shift amount of the center value in accordance with a gradation to be displayed in the pixel section driven in the liquid crystal panel.

Note that, in FIG. 7, the gradation voltage adjustment functions are provided so as to respectively correspond to three gradations such as the 0-th gradation, the X-th gradation, and the 63-th gradation, but the number of gradations is not necessarily limited to three. The gradation voltage adjustment functions are provided so as to respectively correspond to a larger number of gradations, so that it is also possible to adjust the deviation among the gradations in a finer manner.

Embodiment 3

In the source driver 3 of FIG. 2, in order to add the gradation voltage adjustment function of the present invention, it is necessary to add at least one gradation voltage adjustment transmission line and at least one gradation voltage adjustment signal input terminal so as to transmit the gradation voltage adjustment signal DV. In case of supplying the gradation voltage adjustment signals DV from the control IC4 to the source drivers 3 respectively as in Embodiment 1 for example, it is necessary to add a transmission line and an input terminal. In case of supplying the gradation voltage adjustment signals DV0, DVX, and DV36 from the control IC4 as in Embodiment 2, it is necessary to add three transmission lines and three input terminals.

However, in view of a wiring condition of the driving circuit substrate, it is preferable not to increase the number of transmission lines and input terminals. Thus, Embodiment 3 describes a liquid crystal display device in which it is possible to add the gradation voltage adjustment function to the source driver without adding the transmission line and the input terminal.

Figure 8:
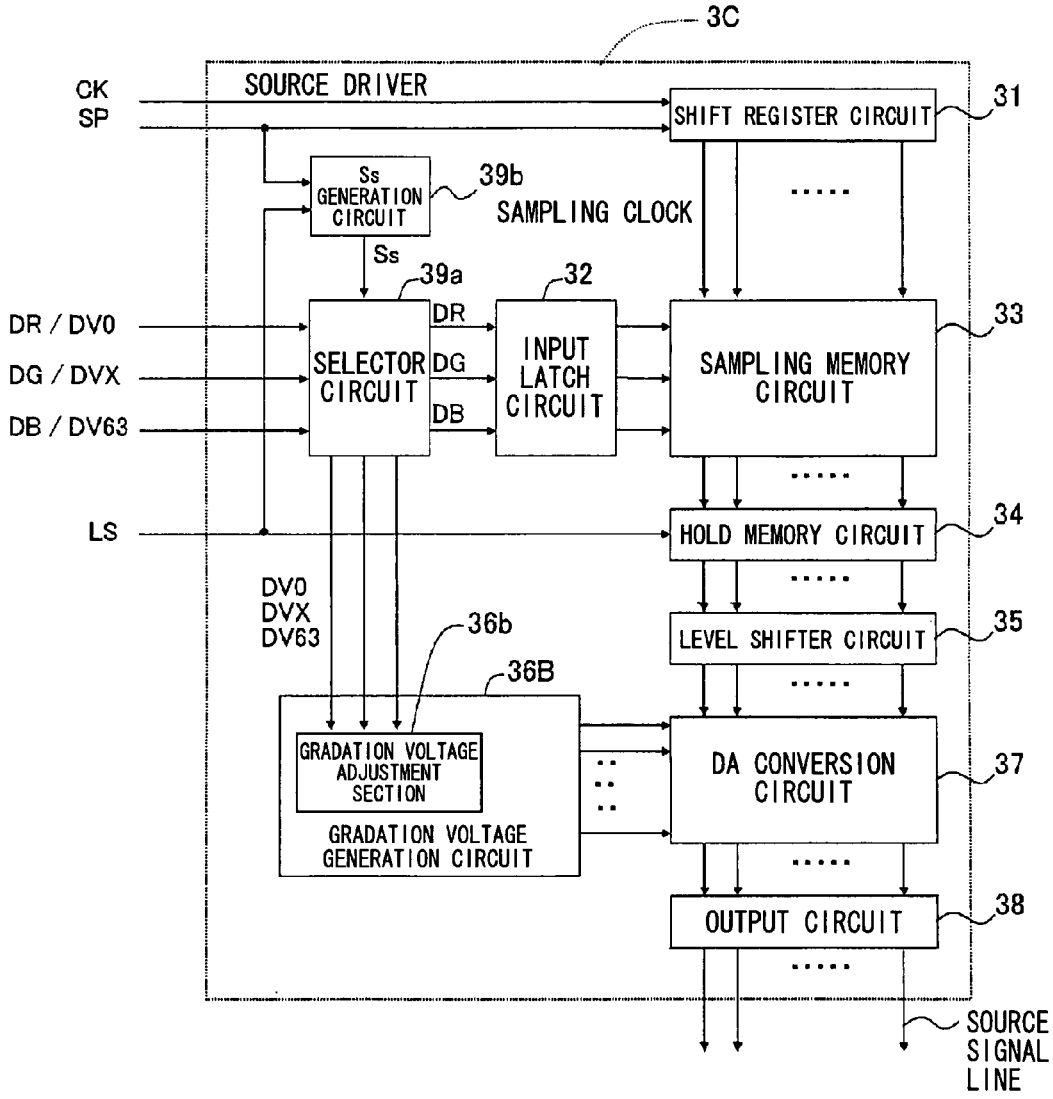
FIG. 8 is a block diagram illustrating an example of an arrangement of a source driver of a liquid crystal display device of Embodiment 3 of the present invention.

Generally, a retrace line period is a nondisplay period, so that it is not necessary to transmit any diode data signal. Thus, in Embodiment 3, a source driver structure illustrated in FIG. 8 is adopted, so that a video signal transmission line is used as a gradation voltage adjustment signal transmission line during the retrace line period, thereby reducing the number of transmission lines. With reference to FIG. 8, this case is detailed as follows.

FIG. 8 is a block diagram illustrating an example of an arrangement of a source driver of the liquid crystal display device of Embodiment 3 of the present invention.

As illustrated in FIG. 8, a source driver 3C includes not only the source driver 3B illustrated in FIG. 2B but also: a selector circuit 39*a* for supplying video data signals DR, DG, and DB and gradation voltage adjustment signals DV0, DVX, and DV63 so that the video data signals DR, DG, and DB are selected and supplied to the input latch circuit 32 during a display period (non retrace line period) and the gradation voltage adjustment signals DV0, DVX, and DV63 are selected and supplied to the gradation voltage adjusting section 36*b* during a nondisplay period (retrace line period); and a selector circuit control signal generation circuit 39*b* for generating a selector circuit control signal Ss in response to the latch signal LS and the start pulse SP which are supplied from the control IC4.

Figure 9:
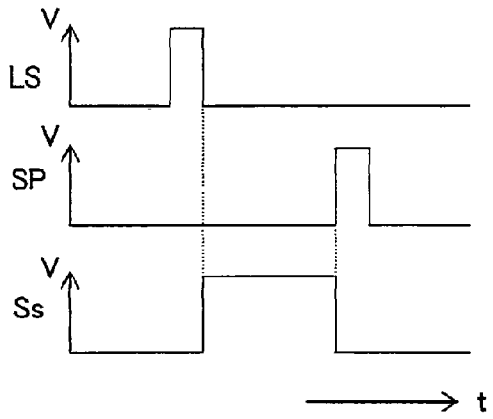
FIG. 9 is a signal waveform chart indicative of a latch signal LS, a start pulse SP, and a selector circuit control signal Ss.

FIG. 9 is a signal waveform chart indicative of the latch signal LS of FIG. 8 and the start pulse SP and the selector circuit control signal Ss.

The selector circuit control signal generation circuit 39*b* generates the selector circuit control signal Ss so that the selector circuit control signal Ss rises when the latch signal LS rises and the selector circuit control signal Ss drops when the start pulse SP rises as illustrated in FIG. 9. When the selector circuit control signal Ss is in an ON state (high level), this indicates the retrace line period. When the selector circuit control signal Ss is in an OFF state (low level), this indicates the non retrace line period. During the non retrace line period (display period), the control IC4 transmits the video data signals DR, DG, and DB to the source driver 3C. During the retrace line period (nondisplay period), the control IC4 transmits the gradation voltage adjustment signals DV0, DVX, and DV63 to the source driver 3C.

Figure 10:
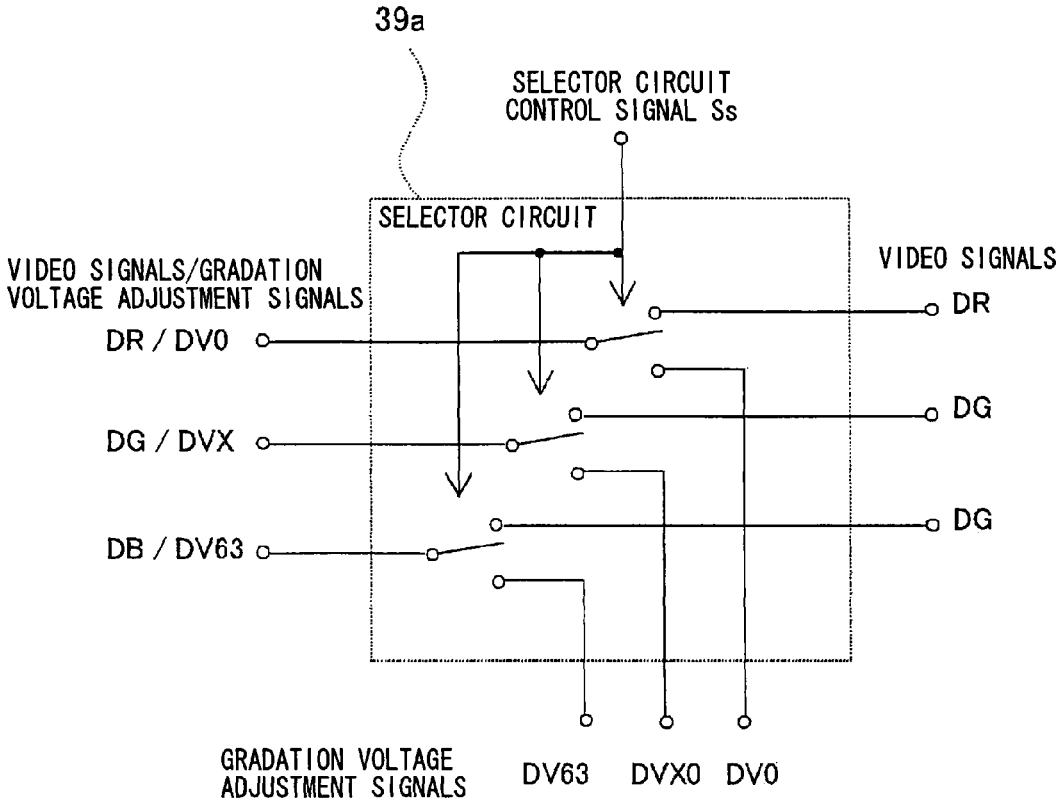
FIG. 10 is a circuit diagram illustrating an example of an arrangement of a selector circuit illustrated in FIG. 8.

FIG. 10 is a circuit diagram illustrating an example of an arrangement of the selector circuit 39*a* of FIG. 8.

As illustrated in FIG. 10, the selector circuit 39*a* is arranged so that output terminals are selected in synchronization with the selector circuit control signal Ss in response to the video data signals DR, DG, and DB which are received as input signals during the non retrace line period and in response to the gradation voltage adjustment signals DV0, DVX, and DV63 which are received as input signals during the retrace line period and each input signal is branched. When the selector circuit control signal Ss is in an OFF state (non retrace line period), the inputted video data signals DR, DG, and DB are outputted toward the input latch circuit 32. When the selector circuit control signal Ss is in an ON state (retrace line period), the gradation voltage adjustment signals DV0, DVX, and DV63 inputted via the same transmission lines as the video data signals are outputted toward the gradation voltage adjusting section 36*b*.

Figure 11:
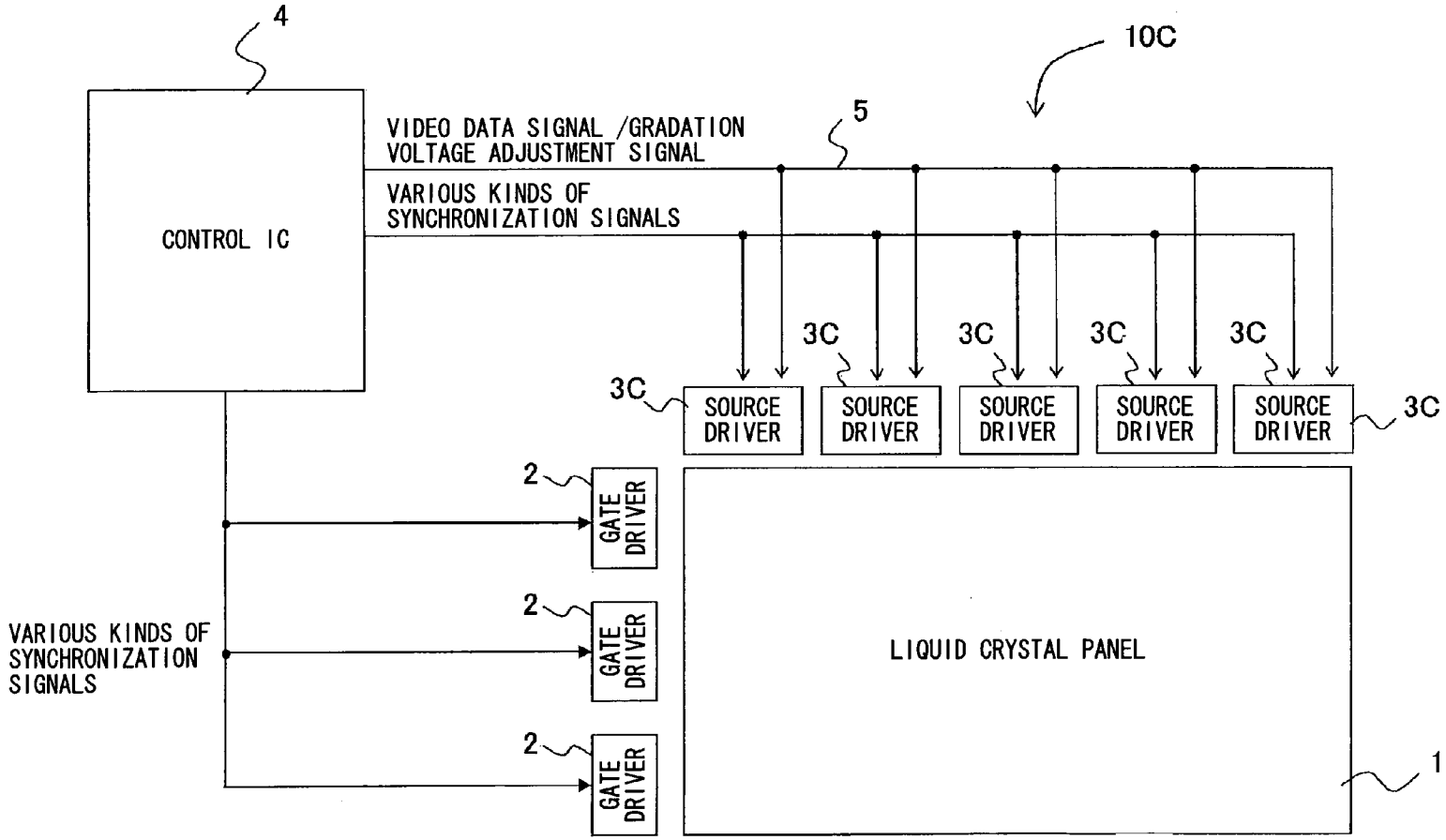
FIG. 11 is a block diagram illustrating an example of an arrangement of a liquid crystal display device having the source driver illustrated in FIG. 8.

FIG. 11 is a block diagram illustrating an example of an arrangement of the liquid crystal display device 10C having the source driver 3C of FIG. 8.

As illustrated in FIG. 11, the control IC4 transmits the video data signals DR, DG, and DB to the source driver 3C via a video signal transmission line 5 during the non retrace line period and transmits the gradation voltage adjustment signal DV during the retrace line period, thereby realizing the source driver 3C having the gradation voltage adjustment function of the present invention without newly adding any transmission line and any driver input terminal on the driving circuit.

As described above, according to Embodiments 1 to 3, the gradation voltage generation circuit 36 or 36B of the source driver 3, 3B, or 3C includes the gradation voltage adjustment section 36*a* or 36*b* for increasing each of the positive gradation voltage VHX of the X-th gradation and the negative gradation voltage VLX of the X-th gradation so that the increment corresponds to the charge pull-in amount ΔV. By adjusting the center value between the positive and negative gradation voltages for each driver in accordance with a slant of the charge pull-in amount ΔV in a gate signal line direction, it is possible to suppress the flicker without varying the gradation characteristic. Further, by adjusting the center value between the positive and negative gradation voltages for each line or every plural lines in a single frame in accordance with a deviation of the charge pull-in amount ΔV in a horizontal direction and in a vertical direction in the transfer block, it is possible to suppress the flicker without varying the gradation characteristic.

Note that, each of Embodiments 1 to 3 described the case where the gradation voltage generation circuit 36 or 36B of the source driver 3, 3B, or 3C includes the gradation voltage adjusting section 36*a* or 36*b* for increasing each of the positive gradation voltage VH(X) of the arbitrary X-th gradation and the negative gradation voltage VL(X) of the arbitrary X-th gradation so that the increment corresponds to the charge pull-in amount ΔV of each pixel section connected to a corresponding video signal line. However, the present invention is not limited to this. It is not necessary to provide the gradation voltage generation circuit 36 or 35B in the source driver 3, 3B, or 3C, and the gradation voltage generation circuit 36 or 35B may be provided in the control IC4. In this case, instead of the gradation voltage adjustment signals and the video data signals, a display gradation signal serving as a video signal is transmitted to the source driver 3, 3B, or 3C.

Further, each of Embodiments 1 to 3 described the case where the gradation voltage generation circuit 36 or 36B carries out voltage adjustment by simultaneously increasing the positive gradation voltage VH(X) of the arbitrary X-th gradation and the negative gradation voltage VL(X) of the arbitrary X-th gradation so that the increment corresponds to the charge pull-in amount ΔV of each pixel section connected to a corresponding scanning signal line for each scanning signal line or every plural scanning signal lines in a single frame or for each gate driver 2. However, in this case, the charge pull-in amount ΔV (adjustment voltage Va) added to a display gradation voltage (video signal) supplied from each source driver 3 to each video signal line is varied in a time base manner, at each timing when each scanning signal line or every plural scanning signal lines are selected and driven in a single frame or at each timing when each gate driver 2 for selecting and driving each scanning signal line or every plural scanning signal lines is driven, so as to optimize the charge pull-in amount ΔV of each pixel section connected to a corresponding scanning signal line.

Further, as to the adjustment voltage Va, an actually shifted voltage is not limited to a value equal to the charge pull-in amount ΔV represented by expression 1, and the voltage is an adjustment voltage which depends on (i) an initial set value of the center value between the positive and negative reference gradation voltages and (ii) the charge pull-in amount ΔV. Thus, the shifted charge is not limited to the "charge pull-in amount ΔV" but is the adjustment voltage Va of FIG. 4.

Thus, the adjustment voltage is an adjustment voltage used to reduce the image flicker and is an adjustment voltage used to shift the positive gradation voltage and the negative gradation voltage of the standard gradation voltage so that the shift corresponds to a predetermined voltage.

Of course, the adjustment voltage may be the charge pull-in amount ΔV or may be a voltage corresponding to the charge pull-in amount ΔV. The charge pull-in amount ΔV is represented by the following expression 1, $$\Delta V=\{Cgd/(Cgd+Clc+Cs)\}\times(VGH-VGL)$$

where Clc represents a liquid crystal capacitance of the pixel electrode, Cs represents an auxiliary capacitance connected to the liquid crystal capacitance, Cgd represents a transistor gate-drain parasitic capacitance of the switch element, VGH represents a gate high voltage of the scanning signal line, and VGL represents a gate low voltage of the scanning signal line.

Each of Embodiments 1 and 2 illustrated an example of the arrangement in which the source driver and the control IC are separated from each other, but it is possible to obtain the same effect of the present invention also in case where the control IC is provided in the source driver.

As described above, each of preferred Embodiments 1 to 3 exemplified the present invention, but the present invention should not be interpreted within the limit of Embodiments 1 to 3. The scope of the present invention should be interpreted based only on claims set forth below. In accordance with the preferred Embodiments 1 to 3 of the present invention, a person skilled in the art can implement the technique whose scope is equal to the present invention through combination of the descriptions of the present invention and the common general knowledge. As to the patents, the patent applications, and documents thereof, which are cited in the present specification, the present invention includes specific descriptions of these documents. Likewise, these documents should be quoted as references to the present specification.

INDUSTRIAL APPLICABILITY

The present invention relates to a field of (i) a liquid crystal display device such as an active matrix type liquid crystal display device used in a display screen such as a television device display and a personal computer monitor and (ii) a liquid crystal display driving circuit used in the liquid crystal display device, wherein a gradation voltage adjustment section is provided on a gradation voltage generation circuit, and a positive gradation voltage VHX of an X-th gradation and a negative gradation voltage VLX of the X-th gradation are simultaneously increased so that the increment corresponds to a charge pull-in amount ΔV so as to vary gradation characteristic, thereby obtaining a favorable display state while suppressing flicker in the entire panel plane.

The invention claimed is:

1. A liquid crystal display device, comprising:

a gradation voltage generation circuit to generate a gradation voltage for display;

a plurality of scanning signal lines and a plurality of video signal lines which intersect with each other; and a plurality of pixel sections, provided in a two dimensional manner, which are sectioned by the scanning signal lines and the video signal lines, the gradation voltage which corresponds to each video data signal being supplied to each of the pixel sections so as to make a display, wherein the gradation voltage generation circuit includes a gradation voltage adjustment section for carrying out voltage adjustment by increasing a positive gradation voltage VH(X) of an X-th gradation and a negative gradation voltage VL(X) of the X-th gradation so that an increment corresponds to an adjustment voltage of a pixel section connected to a corresponding video signal line, and the gradation voltage adjustment section includes first to third adjustment voltage generation circuits each of which generates an adjustment voltage so as to correspond to a gradation voltage adjustment signal supplied from a control section.

2. The liquid crystal display device as set forth in claim 1, comprising a control section for outputting the gradation voltage and various kinds of control signals to a source driver for supplying the gradation voltage to the video signal lines, wherein the gradation voltage generation circuit is provided in the control section.

3. The liquid crystal display device as set forth in claim 2, comprising a signal transmission line for commonly supplying the gradation voltage adjustment signal and the video data signal so that the signal transmission line is positioned between the control section and the source driver.

4. The liquid crystal display device as set forth in claim 3, wherein:

the gradation voltage adjustment signal is supplied via the signal transmission line during a retrace line period, and the video data signal is supplied via the transmission line during a non retrace line period, the source driver further includes (1) a selector circuit control signal generation circuit for generating a selector circuit control signal in accordance with a latch signal and a start pulse which are supplied from the control section and (2) a selector circuit for selecting either the video data signal or the gradation voltage adjustment signal in accordance with the selector circuit control signal.

5. The liquid crystal display device as set forth in claim 4, wherein the selector circuit control signal is generated so that the selector circuit control signal rises when the latch signal drops and the selector circuit control signal drops when the start signal rises.

6. The liquid crystal display device as set forth in claim 4, wherein the selector circuit selects the gradation voltage adjustment signal during a period corresponding to one level of a binary of the selector circuit control signal so as to output the gradation voltage adjustment signal to the gradation voltage adjustment section, and the selector circuit selects the video data signal during a period corresponding to the other level of the binary so as to output the video data signal.

7. The liquid crystal display device as set forth in claim 1, comprising a source driver for supplying the gradation voltage to the video signal lines, wherein the gradation voltage generation circuit is provided in the source driver.

8. The liquid crystal display device as set forth in claim 1, wherein the pixel section includes (i) a switch element whose control terminal is connected to a scanning signal line in a vicinity of each of the junctions of the scanning signal lines and the video signal lines and whose one driving region is connected to a video signal line in the vicinity of the junction and (ii) a pixel electrode connected to the other driving region of the switch element.

9. The liquid crystal display device as set forth in claim 1, wherein the gradation voltage adjustment section carries out voltage adjustment for each video signal line or every plural video signal line in a single frame by increasing the positive gradation voltage VH(X) of the X-th gradation and the negative gradation voltage VL(X) of the X-th gradation so that the increment corresponds to the adjustment voltage of the pixel section connected to the corresponding video signal line.

10. The liquid crystal display device as set forth in claim 9, wherein the adjustment voltage is set so as to correspond to a slant of a charge pull-in amount ΔV in a direction of the scanning signal line.

11. The liquid crystal display device as set forth in claim 9, wherein the adjustment voltage is set so as to correspond to a horizontal direction deviation of the charge pull-in amount ΔV in a transfer block when a panel in-plane deviation which occurs in the charge pull-in amount ΔV due to a plural-region divisional transfer is a horizontal direction deviation.

12. The liquid crystal display device as set forth in claim 1, wherein the gradation voltage adjustment section carries out voltage adjustment for each video signal line or every plural video signal line in a single frame by increasing the positive gradation voltage VH(X) of the X-th gradation and the negative gradation voltage VL(X) of the X-th gradation so that the increment corresponds to the adjustment voltage of the pixel section connected to the corresponding scanning signal line.

13. The liquid crystal display device as set forth in claim 12, wherein the adjustment voltage is set so as to correspond to a slant of a charge pull-in amount ΔV in a direction of the video signal line.

14. The liquid crystal display device as set forth in claim 12, wherein at each timing when each scanning signal line or every plural scanning signal lines are selectively driven, the gradation voltage adjustment section varies the voltage VH(X) and VL(X) including the adjustment voltage or voltages corresponding to the voltage VH(X) and VL(X) including the adjustment voltage in a time base manner so that the voltage is optimal for the charge pull-in amount ΔV of the pixel section connected to the corresponding scanning signal line.

15. The liquid crystal display device as set forth in claim 1, wherein the gradation voltage adjustment section shifts a minimum value and a maximum value of a gradation voltage range, between which the positive gradation voltage VH(X) of the X-th gradation exists, so that also the gradation voltage range between the minimum value and the maximum value is shifted, so as to cause each of the minimum value and the maximum value to be higher by the adjustment voltage, and the gradation voltage adjustment section shifts a minimum value and a maximum value of a gradation voltage range, between which the negative gradation voltage VL(X) of the X-th gradation exists, as well as the gradation voltage range, so as to cause each of the minimum value and the maximum value to be higher by the adjustment voltage.

16. The liquid crystal display device as set forth in claim 1, wherein the gradation voltage generation circuit includes: a first voltage dividing circuit for generating a plurality of positive and negative reference voltages from positive and negative standard voltages; a second voltage dividing circuit for generating a positive gradation voltage from a positive reference voltage; and a third voltage dividing circuit for generating a negative gradation voltage from a negative reference voltage, and the gradation voltage adjustment section outputs (i) a voltage obtained by increasing each reference voltage of the first voltage dividing circuit so that the increment corresponds to an output adjustment voltage or (ii) a voltage corresponding to that obtained voltage, to each of the second and third voltage dividing circuits.

17. The liquid crystal display device as set forth in claim 16, wherein the gradation voltage adjustment section outputs (I) voltages respectively obtained by increasing high and low positive reference voltages of the first voltage dividing circuit so that the increment corresponds to the output adjustment voltage or (II) voltages corresponding to those obtained voltages, respectively as a maximum value and a minimum value of a gradation voltage range of the second voltage dividing circuit, and the gradation voltage adjustment section outputs (III) voltages respectively obtained by increasing high and low negative reference voltages of the first voltage dividing circuit so that the increment corresponds to the output adjustment voltage or (IV) voltages corresponding to those obtained voltages, respectively as a maximum value and a minimum value of a gradation voltage range of the third voltage dividing circuit.

18. The liquid crystal display device as set forth in claim 1, wherein the gradation voltage adjustment section includes differential amplification circuits each of which differentially amplifies a voltage obtained by adding the output adjustment voltage of the adjustment voltage generation circuit to a predetermined reference voltage.

19. The liquid crystal display device as set forth in claim 18, wherein the adjustment voltage generation circuit includes: a variable resistance element whose resistance value is variable in accordance with a voltage value of the gradation voltage adjustment signal; and buffer circuit for receiving an output voltage from the variable resistance element.

20. The liquid crystal display device as set forth in claim 19, wherein the variable resistance element is a potentiometer.

21. The liquid crystal display device as set forth in claim 18, wherein the differential amplification circuits are provided so as to respectively correspond to a positive maximum gradation voltage, a positive minimum gradation voltage, a negative maximum gradation voltage, and a negative minimum gradation voltage, and a positive input terminal of each of the differential amplification circuits is connected to an output terminal via which a predetermined reference voltage is outputted from the first voltage dividing circuit and an output terminal of the adjustment voltage generation circuit, and an output terminal of each of the differential amplification circuits are connected to either the second voltage dividing circuit or the third voltage dividing circuit.

22. The liquid crystal display device as set forth in claim 21, wherein:

the differential amplification circuits are first to fourth differential amplification circuits, and the first differential amplification circuit receives via its positive input terminal a voltage obtained by increasing a positive first reference voltage of the first voltage dividing circuit so that the increment corresponds to the output adjustment voltage and the first differential amplification circuit outputs an output voltage to a part of an output terminal via which the maximum value of the gradation voltage range of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which the minimum value of the gradation voltage range of the second voltage dividing circuit is outputted, and the third differential amplification circuit receives via its positive input terminal a voltage obtained by increasing a negative third reference voltage of the first voltage dividing circuit so that the increment corresponds to the output adjustment voltage and the third differential amplification circuit outputs an output voltage to a part of an output terminal via which a maximum value of a gradation voltage range of the third voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a minimum value of the gradation voltage range of the third voltage dividing circuit is outputted.

23. The liquid crystal display device as set forth in claim 18, wherein:

the adjustment voltage generation circuits are fourth to n-th (n is a natural number not less than 5) adjustment voltage generation circuits for generating adjustment voltages corresponding to respective gradations, and the number of the differential amplification circuits is n×2 so as to correspond to each of positive and negative gradation voltages, and a positive input terminal of each of the differential amplification circuits is connected to (I) an output section via which a predetermined reference voltage is outputted from the first voltage dividing circuit and (II) any one of output terminals of the first to n-th adjustment voltage generation circuits which corresponds to the output section, and an output terminal of each of the differential amplification circuits is connected to either a position of the second voltage dividing circuit or a position of the third voltage dividing circuit so that the positions correspond to each other as positive and negative sides.

24. The liquid crystal display device as set forth in claim 18, wherein:

the first to third adjustment voltage generation circuits generate adjustment voltages according to gradations respectively corresponding to a maximum gradation voltage, an intermediate gradation voltage, and a minimum gradation voltage, and the differential amplification circuits are provided so that output voltage values thereof respectively become a positive maximum gradation voltage, a positive intermediate gradation voltage, a positive minimum gradation voltage, a negative maximum gradation voltage, a negative intermediate gradation voltage, a negative minimum gradation voltage, and a positive input terminal of each of the differential amplification circuits is connected to (I) an output section via which a predetermined reference voltage is outputted from the first voltage dividing circuit and (II) any one of output terminals of the first to third adjustment voltage generation circuits which corresponds to the output section, an output terminal of each of the differential amplification circuits is connected to either the second voltage dividing circuit or the third voltage dividing circuit so that the second and third voltage dividing circuits symmetrically correspond to each other as positive and negative sides.

25. The liquid crystal display device as set forth in claim 24, wherein:

the differential amplification circuits are first to sixth differential amplification circuits, and the first differential amplification circuit receives via its positive input terminal a voltage obtained by increasing a positive first reference voltage of the first voltage dividing circuit so that the increment corresponds to the output adjustment voltage of the first adjustment voltage generation circuit and the first differential amplification circuit outputs an output voltage to a part of an output terminal via which a positive maximum gradation voltage of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which a positive intermediate gradation voltage of the second voltage dividing circuit is outputted, and the third differential amplification circuit receives via its positive input terminal a voltage obtained by increasing a positive third reference voltage of the first voltage dividing circuit so that the increment corresponds to the output adjustment voltage and the third differential amplification circuit outputs an output voltage to a part of an output terminal via which a positive minimum gradation voltage of the second voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a negative maximum gradation voltage of the third voltage dividing circuit is outputted, and the fifth differential amplification circuit receives via its positive input terminal a voltage obtained by increasing a negative fifth reference voltage of the first voltage dividing circuit so that the increment corresponds to the output adjustment voltage and the fifth differential amplification circuit outputs an output voltage to a part of an output terminal via which a negative intermediate gradation voltage of the third voltage dividing circuit is outputted, and the sixth differential amplification circuit receives via its positive input terminal a voltage obtained by increasing a negative sixth reference voltage of the first voltage dividing circuit so that the increment corresponds to the output adjustment voltage and the sixth differential amplification circuit outputs an output voltage to a part of an output terminal via which a negative minimum gradation voltage of the third voltage dividing circuit is outputted.

26. The liquid crystal display device as set forth in claim 18, wherein the gradation voltage adjustment section carries out voltage adjustment with respect to the positive gradation voltage VH(X) of the X-th gradation and the negative gradation voltage VL(X) of the X-th gradation so that the voltage adjustment corresponds to each of gradations independently.

27. The liquid crystal display device as set forth in claim 1, comprising a first signal transmission line for supplying the gradation voltage adjustment signal and a second signal transmission line for supplying the video data signal so that the first signal transmission line and the second signal transmission line are positioned between the control section and the source driver.

28. The liquid crystal display device as set forth in claim 1, wherein the gradation voltage adjustment circuit is configured to reduce an image flicker based on the adjustment voltage.

29. The liquid crystal display device as set forth in claim 28, wherein the adjustment voltage is an adjustment voltage used to shift a center value between a positive gradation voltage and a negative gradation voltage of a standard gradation voltage so that the shift corresponds to a predetermined voltage.

30. The liquid crystal display device as set forth in claim 28, wherein the adjustment voltage has a voltage value which depends on (a) an initial set value of the center value between the positive gradation voltage and the negative gradation voltage of the standard gradation voltage and (b) a charge pull-in amount ΔV.

31. The liquid crystal display device as set forth in claim 28, wherein the adjustment voltage is a charge pull-in amount ΔV or corresponds to the charge pull-in amount ΔV.

32. The liquid crystal display device as set forth in claim 31, wherein:

the pixel section includes (i) a switch element whose control terminal is connected to a scanning signal line in a vicinity of each of the junctions of the scanning signal lines and the video signal lines and whose one driving region is connected to a video signal line in the vicinity of the junction and (ii) a pixel electrode connected to the other driving region of the switch element, and the charge pull-in amount ΔV is expressed as follows $$\Delta V=\{Cgd/(Cgd+Clc+Cs)\}\times(VGH-VGL)$$

where Clc represents a liquid crystal capacitance of the pixel electrode, Cs represents an auxiliary capacitance connected to the liquid crystal capacitance Clc, Cgd represents a transistor gate-drain parasitic capacitance of the switch element, VGH represents a gate high voltage of the scanning signal line, and VGL represents a gate low voltage of the scanning signal line.

33. A liquid crystal display device, comprising:

a display section which includes a plurality of scanning signal lines and a plurality of video signal lines so that the scanning signal lines and the video signal lines intersect with each other and which includes pixel sections sectioned by the scanning signal lines and the video signal lines so that the pixel sections are provided in a matrix manner;

a plurality of source drivers, provided in a vicinity of the display section so as to respectively correspond to a predetermined number of the video signal lines, each of which source drivers selectively supplies a positive gradation voltage or a negative gradation voltage as a video signal; and a plurality of gate drivers, provided in a vicinity of the display section so as to respectively correspond to a predetermined number of the scanning signal lines, each of which gate drivers selectively supplies a scanning signal for driving each of the pixel sections to each of the scanning signal lines; wherein gradation voltage generation circuits each of which generates a gradation voltage for display are provided in the source drivers respectively, and each of the gradation voltage generation circuits includes a gradation voltage adjustment section for carrying out voltage adjustment by increasing a positive gradation voltage VH(X) of an X-th gradation and a negative gradation voltage VL(X) of the X-th gradation so that an increment corresponds to an adjustment voltage of a pixel section connected to a corresponding video signal line, wherein the gradation voltage adjustment section includes first to third adjustment voltage generation circuits each of which generates an adjustment voltage so as to correspond to a gradation voltage adjustment signal supplied from a control section.

34. The liquid crystal display device as set forth in claim 33, wherein the gradation voltage adjustment section carries out voltage adjustment for each source driver by increasing the positive gradation voltage VH(X) of the X-th gradation and the negative gradation voltage VL(X) of the X-th gradation so that the increment corresponds to the adjustment voltage of the pixel section connected to the corresponding video signal line.

35. The liquid crystal display device as set forth in claim 33, wherein the gradation voltage adjustment section carries out voltage adjustment for each source driver by increasing the positive gradation voltage VH(X) of the X-th gradation and the negative gradation voltage VL(X) of the X-th gradation so that the increment corresponds to the adjustment voltage of the pixel section connected to the corresponding scanning signal line.

36. A liquid crystal display driving circuit, comprising a gradation voltage generation circuit for generating a positive and negative display gradation voltage so as to drive a liquid crystal display section by using the display gradation voltage so that the liquid crystal display section displays an image, wherein the gradation voltage generation circuit includes a gradation voltage adjustment section for carrying out voltage adjustment by increasing a positive gradation voltage VH(X) of an X-th gradation and a negative gradation voltage VL(X)of the X-th gradation so that an increment corresponds to an adjustment voltage of a pixel section to which a corresponding video signal is supplied, wherein the gradation voltage adjustment section includes first to third adjustment voltage generation circuits each of which generates an adjustment voltage so as to correspond to a gradation voltage adjustment signal supplied from a control section.

37. The liquid crystal display driving circuit as set forth in claim 36, comprising:

a plurality of source drivers each of which supplies the positive and negative display gradation voltage to the liquid crystal display section as a video signal; and a plurality of gate drivers each of which supplies a liquid crystal display driving scanning signal to the liquid crystal display section, wherein the gradation voltage generation circuit is provided in each of the source drivers.

38. The liquid crystal display driving circuit as set forth in claim 37, wherein at each timing where the scanning signal lines are driven or at each timing when each of the gate drivers is driven, the gradation voltage adjustment section varies the voltage VH(X) and VL(X) including the adjustment voltage or voltages corresponding to the voltage VH(X) and VL(X) including the adjustment voltage in a time base manner so that the voltage is optimal for a charge pull-in amount $\Delta V$ of the pixel section connected to a corresponding scanning signal line.

39. The liquid crystal display driving circuit as set forth in claim 37, wherein the gradation voltage adjustment section shifts a minimum value and a maximum value of a gradation voltage range, between which the positive gradation voltage VH(X) of the X-th gradation exists, so that also the gradation voltage range between the minimum value and the maximum value is shifted, so as to cause each of the minimum value and the maximum value to be higher by the adjustment voltage, and the gradation voltage adjustment section shifts a minimum value and a maximum value of a gradation voltage range, between which the negative gradation voltage VL(X) of the X-th gradation exists, as well as the gradation voltage range, so as to cause each of the minimum value and the maximum value to be higher by the adjustment voltage.

40. The liquid crystal display driving circuit as set forth in claim 36, wherein the gradation voltage generation circuit includes: a first voltage dividing circuit for generating a plurality of positive and negative reference voltages from positive and negative standard voltages; a second voltage dividing circuit for generating a positive gradation voltage from a positive reference voltage; and a third voltage dividing circuit for generating a negative gradation voltage from a negative reference voltage, and the gradation voltage adjustment section outputs (i) a voltage obtained by increasing each reference voltage of the first voltage dividing circuit so that the increment corresponds to an output adjustment voltage or (ii) a voltage corresponding to that obtained voltage, to each of the second and third voltage dividing circuits.

41. The liquid crystal display driving circuit as set forth in claim 40, wherein the gradation voltage adjustment section outputs (I) voltages respectively obtained by increasing high and low positive reference voltages of the first voltage dividing circuit so that the increment corresponds to the output adjustment voltage or (II) voltages corresponding to those obtained voltages, respectively as a maximum value and a minimum value of a gradation voltage range of the second voltage dividing circuit, and the gradation voltage adjustment section outputs (III) voltages respectively obtained by increasing high and low negative reference voltages of the first voltage dividing circuit so that the increment corresponds to the output adjustment voltage or (IV) voltages corresponding to those obtained voltages, respectively as a maximum value and a minimum value of a gradation voltage range of the third voltage dividing circuit.

42. The liquid crystal display driving circuit as set forth in claim 36, wherein the gradation voltage adjustment section includes: one or more adjustment voltage generation circuits each of which generates an adjustment voltage so as to correspond to a gradation voltage adjustment signal supplied from a control section; and differential amplification circuits each of which differentially amplifies a voltage obtained by adding the output adjustment voltage of the adjustment voltage generation circuit to a predetermined reference voltage.

43. The liquid crystal display driving circuit as set forth in claim 42, wherein the adjustment voltage generation circuit includes: a variable resistance element whose resistance value is variable in accordance with a voltage value of the gradation voltage adjustment signal; and buffer circuit for receiving an output voltage from the variable resistance element.

44. The liquid crystal display driving circuit as set forth in claim 42, wherein the differential amplification circuits are provided so as to respectively correspond to a positive maximum gradation voltage, a positive minimum gradation voltage, a negative maximum gradation voltage, and a negative minimum gradation voltage, and a positive input terminal of each of the differential amplification circuits is connected to an output terminal via which a predetermined reference voltage is outputted from the first voltage dividing circuit and an output terminal of the adjustment voltage generation circuit, and an output terminal of each of the differential amplification circuits are connected to either the second voltage dividing circuit or the third voltage dividing circuit.

45. The liquid crystal display driving circuit as set forth in claim 44, wherein:

the differential amplification circuits are first to fourth differential amplification circuits, and the first differential amplification circuit receives via its positive input terminal a voltage obtained by increasing a positive first reference voltage of the first voltage dividing circuit so that the increment corresponds to the output adjustment voltage and the first differential amplification circuit outputs an output voltage to a part of an output terminal via which the maximum value of the gradation voltage range of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which the minimum value of the gradation voltage range of the second voltage dividing circuit is outputted, and the third differential amplification circuit receives via its positive input terminal a voltage obtained by increasing a negative third reference voltage of the first voltage dividing circuit so that the increment corresponds to the output adjustment voltage and the third differential amplification circuit outputs an output voltage to a part of an output terminal via which a maximum value of a gradation voltage range of the third voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a minimum value of the gradation voltage range of the third voltage dividing circuit is outputted.

46. The liquid crystal display driving circuit as set forth in claim 42, wherein:

the adjustment voltage generation circuits are first to n-th (n is a natural number not less than 2) adjustment voltage generation circuits for generating adjustment voltages corresponding to respective gradations, and the number of the differential amplification circuits is n×2 so as to correspond to each of positive and negative gradation voltages, and a positive input terminal of each of the differential amplification circuits is connected to (I) an output section via which a predetermined reference voltage is outputted from the first voltage dividing circuit and (II) any one of output terminals of the first to n-th adjustment voltage generation circuits which corresponds to the output section, and an output terminal of each of the differential amplification circuits is connected to either a position of the second voltage dividing circuit or a position of the third voltage dividing circuit so that the positions correspond to each other as positive and negative sides.

47. The liquid crystal display driving circuit as set forth in claim 42, wherein:

the adjustment voltage generation circuits are first to third adjustment voltage generation circuits for generating adjustment voltages according to gradations respectively corresponding to a maximum gradation voltage, an intermediate gradation voltage, and a minimum gradation voltage, and the differential amplification circuits are provided so that output voltage values thereof respectively become a positive maximum gradation voltage, a positive intermediate gradation voltage, a positive minimum gradation voltage, a negative maximum gradation voltage, a negative intermediate gradation voltage, a negative minimum gradation voltage, and a positive input terminal of each of the differential amplification circuits is connected to (I) an output section via which a predetermined reference voltage is outputted from the first voltage dividing circuit and (II) any one of output terminals of the first to third adjustment voltage generation circuits which corresponds to the output section, an output terminal of each of the differential amplification circuits is connected to either the second voltage dividing circuit or the third voltage dividing circuit so that the second and third voltage dividing circuits symmetrically correspond to each other as positive and negative sides.

48. The liquid crystal display driving circuit as set forth in claim 47, wherein:

the differential amplification circuits are first to sixth differential amplification circuits, and the first differential amplification circuit receives via its positive input terminal a voltage obtained by increasing a positive first reference voltage of the first voltage dividing circuit so that the increment corresponds to the output adjustment voltage of the first adjustment voltage generation circuit and the first differential amplification circuit outputs an output voltage to a part of an output terminal via which a positive maximum gradation voltage of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which a positive intermediate gradation voltage of the second voltage dividing circuit is outputted, and the third differential amplification circuit receives via its positive input terminal a voltage obtained by increasing a positive third reference voltage of the first voltage dividing circuit so that the increment corresponds to the output adjustment voltage and the third differential amplification circuit outputs an output voltage to a part of an output terminal via which a positive minimum gradation voltage of the second voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a negative maximum gradation voltage of the third voltage dividing circuit is outputted, and the fifth differential amplification circuit receives via its positive input, terminal a voltage obtained by increasing a negative fifth reference voltage of the first voltage dividing circuit so that the increment corresponds to the output adjustment voltage and the fifth differential amplification circuit outputs an output voltage to a part of an output terminal via which a negative intermediate gradation voltage of the third voltage dividing circuit is outputted, and the sixth differential amplification circuit receives via its positive input terminal a voltage obtained by increasing a negative sixth reference voltage of the first voltage dividing circuit so that the increment corresponds to the output adjustment voltage and the sixth differential amplification circuit outputs an output voltage to a part of an output terminal via which a negative minimum gradation voltage of the third voltage dividing circuit is outputted.

49. The liquid crystal display driving circuit as set forth in claim 42, wherein the gradation voltage adjustment section carries out voltage adjustment with respect to the positive gradation voltage VH(X) of the X-th gradation and the negative gradation voltage VL(X) of the X-th gradation so that the voltage adjustment corresponds to each of gradations independently.

50. A liquid crystal panel display circuit, inversely driving a liquid crystal panel and causing a pixel section of the liquid crystal panel to display gradations, said liquid crystal panel display circuit comprising:

a gradation voltage generation section for generating a positive gradation voltage and a negative gradation voltage which are used for inversion driving;

a gradation voltage adjustment section for shifting a center value between the positive gradation voltage and the negative gradation voltage which are generated by the gradation voltage generation section, the gradation voltage adjustment section includes first to third adjustment voltage generation circuits each of which generates an adjustment voltage so as to correspond to a gradation voltage adjustment signal supplied from a control section; and a control section for setting a shift amount of the gradation voltage adjustment section in accordance with the pixel section driven in the liquid crystal panel.

51. The liquid crystal panel display circuit as set forth in claim 50, wherein the control section further sets the shift amount so as to correspond to a gradation displayed in the pixel section driven in the liquid crystal panel.

52. A liquid crystal display device, comprising:

a gradation voltage generation circuit to generate a gradation voltage for display;

a plurality of scanning signal lines and a plurality of video signal lines which intersect with each other; and a plurality of pixel sections, provided in a two dimensional manner, which are sectioned by the scanning signal lines and the video signal lines, the gradation voltage which corresponds to each video data signal being supplied to each of the pixel sections so as to make a display, wherein the gradation voltage generation circuit includes a gradation voltage adjustment section for carrying out voltage adjustment by increasing a positive gradation voltage VH(X) of an X-th gradation and a negative gradation voltage VL(X) of the X-th gradation so that an increment corresponds to an adjustment voltage of a pixel section connected to a corresponding video signal line, the gradation voltage adjustment section include: one ore more adjustment voltage generation circuits each of which generates an adjustment voltage so as to correspond to a gradation voltage adjustment signal supplied from a control section and differential amplification circuits each of which differentially amplifies a voltage obtained by adding the output adjustment voltage of the adjustment voltage generation circuit to a predetermined reference voltage, the adjustment voltage generation circuits are fourth to n-th (n is a natural number not less than 5) adjustment voltage generation circuits for generating adjustment voltages corresponding to respective gradations, and the number of the differential amplification circuits is n×2 so as to correspond to each of positive and negative gradation voltages, and a positive input terminal of each of the differential amplification circuits is connected to (I) an output section via which a predetermined reference voltage is outputted from the first voltage dividing circuit and (II) any one of output terminals of the first to n-th adjustment voltage generation circuits which corresponds to the output section, and an output terminal of each of the differential amplification circuits is connected to either a position of the second voltage dividing circuit or a position of the third voltage dividing circuit so that the positions correspond to each other as positive and negative sides.

53. A liquid crystal display device, comprising:

a gradation voltage generation circuit to generate a gradation voltage for display;

a plurality of scanning signal lines and a plurality of video signal lines which intersect with each other; and a plurality of pixel sections, provided in a two dimensional manner, which are sectioned by the scanning signal lines and the video signal lines, the gradation voltage which corresponds to each video data signal being supplied to each of the pixel sections so as to make a display, wherein the gradation voltage generation circuit includes a gradation voltage adjustment section for carrying out voltage adjustment by increasing a positive gradation voltage VH(X) of an X-th gradation and a negative gradation voltage VL(X) of the X-th gradation so that an increment corresponds to an adjustment voltage of a pixel section connected to a corresponding video signal line, the gradation voltage adjustment section include: one ore more adjustment voltage generation circuits each of which generates an adjustment voltage so as to correspond to a gradation voltage adjustment signal supplied from a control section and differential amplification circuits each of which differentially amplifies a voltage obtained by adding the output adjustment voltage of the adjustment voltage generation circuit to a predetermined reference voltage, the first to third adjustment voltage generation circuits generate adjustment voltages according to gradations respectively corresponding to a maximum gradation voltage, an intermediate gradation voltage, and a minimum gradation voltage, and the differential amplification circuits are provided so that output voltage values thereof respectively become a positive maximum gradation voltage, a positive intermediate gradation voltage, a positive minimum gradation voltage, a negative maximum gradation voltage, a negative intermediate gradation voltage, a negative minimum gradation voltage, and a positive input terminal of each of the differential amplification circuits is connected to (I) an output section via which a predetermined reference voltage is outputted from the first voltage dividing circuit and (II) any one of output terminals of the first to third adjustment voltage generation circuits which corresponds to the output section, an output terminal of each of the differential amplification circuits is connected to either the second voltage dividing circuit or the third voltage dividing circuit so that the second and third voltage dividing circuits symmetrically correspond to each other as positive and negative sides.

54. The liquid crystal display device as set forth in claim 53, wherein:

the differential amplification circuits are first to sixth differential amplification circuits, and the first differential amplification circuit receives via its positive input terminal a voltage obtained by increasing a positive first reference voltage of the first voltage dividing circuit so that the increment corresponds to the output adjustment voltage of the first adjustment voltage generation circuit and the first differential amplification circuit outputs an output voltage to a part of an output terminal via which a positive maximum gradation voltage of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which a positive intermediate gradation voltage of the second voltage dividing circuit is outputted, and the third differential amplification circuit receives via its positive input terminal a voltage obtained by increasing a positive third reference voltage of the first voltage dividing circuit so that the increment corresponds to the output adjustment voltage and the third differential amplification circuit outputs an output voltage to a part of an output terminal via which a positive minimum gradation voltage of the second voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a negative maximum gradation voltage of the third voltage dividing circuit is outputted, and the fifth differential amplification circuit receives via its positive input terminal a voltage obtained by increasing a negative fifth reference voltage of the first voltage dividing circuit so that the increment corresponds to the output adjustment voltage and the fifth differential amplification circuit outputs an output voltage to a part of an output terminal via which a negative intermediate gradation voltage of the third voltage dividing circuit is outputted, and the sixth differential amplification circuit receives via its positive input terminal a voltage obtained by increasing a negative sixth reference voltage of the first voltage dividing circuit so that the increment corresponds to the output adjustment voltage and the sixth differential amplification circuit outputs an output voltage to a part of an output terminal via which a negative minimum gradation voltage of the third voltage dividing circuit is outputted.

55. A liquid crystal display driving circuit, comprising a gradation voltage generation circuit for generating a positive and negative display gradation voltage so as to drive a liquid crystal display section by using the display gradation voltage so that the liquid crystal display section displays an image, wherein the gradation voltage generation circuit includes a gradation voltage adjustment section for carrying out voltage adjustment by increasing a positive gradation voltage VH(X) of an X-th gradation and a negative gradation voltage VL(X)of the X-th gradation so that an increment corresponds to an adjustment voltage of a pixel section to which a corresponding video signal is supplied, the gradation voltage adjustment section includes one or more adjustment voltage generation circuits each of which generates an adjustment voltage so as to correspond to a gradation voltage adjustment signal supplied from a control section and differential amplification circuits each of which differentially amplifies a voltage obtained by adding the output adjustment voltage of the adjustment voltage generation circuit to a predetermined reference voltage, the adjustment voltage generation circuits are first to n-th (n is a natural number not less than 2) adjustment voltage generation circuits for generating adjustment voltages corresponding to respective gradations, and the number of the differential amplification circuits is n×2 so as to correspond to each of positive and negative gradation voltages, and a positive input terminal of each of the differential amplification circuits is connected to (I) an output section via which a predetermined reference voltage is outputted from the first voltage dividing circuit and (II) any one of output terminals of the first to n-th adjustment voltage generation circuits which corresponds to the output section, and an output terminal of each of the differential amplification circuits is connected to either a position of the second voltage dividing circuit or a position of the third voltage dividing circuit so that the positions correspond to each other as positive and negative sides.

56. A liquid crystal display driving circuit, comprising a gradation voltage generation circuit for generating a positive and negative display gradation voltage so as to drive a liquid crystal display section by using the display gradation voltage so that the liquid crystal display section displays an image, wherein the gradation voltage generation circuit includes a gradation voltage adjustment section for carrying out voltage adjustment by increasing a positive gradation voltage VH(X) of an X-th gradation and a negative gradation voltage VL(X)of the X-th gradation so that an increment corresponds to an adjustment voltage of a pixel section to which a corresponding video signal is supplied, the gradation voltage adjustment section includes one or more adjustment voltage generation circuits each of which generates an adjustment voltage so as to correspond to a gradation voltage adjustment signal supplied from a control section and differential amplification circuits each of which differentially amplifies a voltage obtained by adding the output adjustment voltage of the adjustment voltage generation circuit to a predetermined reference voltage, the adjustment voltage generation circuits are first to third adjustment voltage generation circuits for generating adjustment voltages according to gradations respectively corresponding to a maximum gradation voltage, an intermediate gradation voltage, and a minimum gradation voltage, and the differential amplification circuits are provided so that output voltage values thereof respectively become a positive maximum gradation voltage, a positive intermediate gradation voltage, a positive minimum gradation voltage, a negative maximum gradation voltage, a negative intermediate gradation voltage, a negative minimum gradation voltage, and a positive input terminal of each of the differential amplification circuits is connected to (I) an output section via which a predetermined reference voltage is outputted from the first voltage dividing circuit and (II) any one of output terminals of the first to third adjustment voltage generation circuits which corresponds to the output section, an output terminal of each of the differential amplification circuits is connected to either the second voltage dividing circuit or the third voltage dividing circuit so that the second and third voltage dividing circuits symmetrically correspond to each other as positive and negative sides.

57. The liquid crystal display driving circuit as set forth in claim 56, wherein:

the differential amplification circuits are first to sixth differential amplification circuits, and the first differential amplification circuit receives via its positive input terminal a voltage obtained by increasing a positive first reference voltage of the first voltage dividing circuit so that the increment corresponds to the output adjustment voltage of the first adjustment voltage generation circuit and the first differential amplification circuit outputs an output voltage to a part of an output terminal via which a positive maximum gradation voltage of the second voltage dividing circuit is outputted, and the second differential amplification circuit receives via its positive input terminal a voltage obtained by increasing a positive second reference voltage of the first voltage dividing circuit so that the increment corresponds to the output adjustment voltage and the second differential amplification circuit outputs an output voltage to a part of an output terminal via which a positive intermediate gradation voltage of the second voltage dividing circuit is outputted, and the third differential amplification circuit receives via its positive input terminal a voltage obtained by increasing a positive third reference voltage of the first voltage dividing circuit so that the increment corresponds to the output adjustment voltage and the third differential amplification circuit outputs an output voltage to a part of an output terminal via which a positive minimum gradation voltage of the second voltage dividing circuit is outputted, and the fourth differential amplification circuit receives via its positive input terminal a voltage obtained by increasing a negative fourth reference voltage of the first voltage dividing circuit so that the increment corresponds to the output adjustment voltage and the fourth differential amplification circuit outputs an output voltage to a part of an output terminal via which a negative maximum gradation voltage of the third voltage dividing circuit is outputted, and the fifth differential amplification circuit receives via its positive input terminal a voltage obtained by increasing a negative fifth reference voltage of the first voltage dividing circuit so that the increment corresponds to the output adjustment voltage and the fifth differential amplification circuit outputs an output voltage to a part of an output terminal via which a negative intermediate gradation voltage of the third voltage dividing circuit is outputted, and the sixth differential amplification circuit receives via its positive input terminal a voltage obtained by increasing a negative sixth reference voltage of the first voltage dividing circuit so that the increment corresponds to the output adjustment voltage and the sixth differential amplification circuit outputs an output voltage to a part of an output terminal via which a negative minimum gradation voltage of the third voltage dividing circuit is outputted.

* * * * *

UNITED STATES PATENT AND TRADEMARK OFFICE

CERTIFICATE OF CORRECTION

PATENT NO. : 8,094,108 B2
APPLICATION NO. : 11/792039
DATED : January 10, 2012
INVENTOR(S) : Hiroyuki Higashino et al.

It is certified that error appears in the above-identified patent and that said Letters Patent is hereby corrected as shown below:

Title page should read

Item (22) PCT Filed: Jan. 30, 2006

Item (86) PCT No.: PCT/JP2006/301487

§371 (c)(1),
(2), (4) Date: Jun. 1, 2007

Signed and Sealed this
Thirteenth Day of March, 2012

David J. Kappos

David J. Kappos
*Director of the United States Patent and Trademark Office*